US009414655B2

(12) United States Patent
Pao

(10) Patent No.: US 9,414,655 B2
(45) Date of Patent: Aug. 16, 2016

(54) WALKING STICK CHAIR

(71) Applicant: Chih-Ting Pao, Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 0 days.

(21) Appl. No.: 13/962,920

(22) Filed: Aug. 8, 2013

(65) Prior Publication Data

US 2014/0034098 A1 Feb. 6, 2014

Related U.S. Application Data

(63) Continuation-in-part of application No. 13/831,566, filed on Mar. 14, 2013.

(30) Foreign Application Priority Data

Aug. 1, 2012 (TW) ..... 101127837 A
Aug. 1, 2012 (TW) ..... 101127841 A
Dec. 17, 2012 (TW) ..... 101147797 A

(51) Int. Cl.
*A45B 5/00* (2006.01)

(52) U.S. Cl.
CPC ..... *A45B 5/00* (2013.01)

(58) Field of Classification Search
CPC ..... A45B 25/16; A45B 5/00
USPC ..... 135/66; 297/118, 16.1, 16.2, 183.5
See application file for complete search history.

(56) References Cited

U.S. PATENT DOCUMENTS 617,661 A * 1/1899 Smith ..... A47C 4/40 297/118
1,972,668 A * 9/1934 Sheldon ..... 248/155.2
2,133,047 A * 10/1938 Sheldon ..... 297/55
2,380,437 A 7/1945 Homrighausen
2,380,439 A 7/1945 Hoskins et al.
2,629,429 A * 2/1953 Baumfeld et al. ..... 297/58
2,766,813 A * 10/1956 Kay ..... 297/54
3,073,327 A * 1/1963 Foltis et al. ..... 135/22
3,266,839 A * 8/1966 Combs ..... 297/57

(Continued)

FOREIGN PATENT DOCUMENTS

CN 2123908 U 12/1992
CN 2471165 1/2002

(Continued)

OTHER PUBLICATIONS

Chinese Search Report dated Jan. 28, 2015 regarding Chinese Application No. 2012105387647 (4 pages).

(Continued)

*Primary Examiner* — Noah Chandler Hawk
(74) *Attorney, Agent, or Firm* — DLA Piper LLP (US)

(57) ABSTRACT

A walking stick chair includes a main stick, a seat unit, a support unit, and a linking unit. The seat unit includes an upper slider member connected to the main stick and movable between first and second positions, and a seat member connected to the upper slider member. The support unit is connected to the main stick. The linking unit is connected to the support unit and the seat unit. The walking stick chair is at an unfolded state when the upper slider member is at the second position, and is converted from the unfolded state to a folded state when the upper slider member moves from the second position to the first position.

17 Claims, 28 Drawing Sheets

(56) References Cited

U.S. PATENT DOCUMENTS

| | | | | |
|---|---|---|---|---|
| 3,310,340 | A * | 3/1967 | Brewer et al. | 297/16.1 |
| 3,537,748 | A * | 11/1970 | Knapp | 297/118 |
| 3,999,565 | A | 12/1976 | Delacour et al. | |
| 6,899,388 | B1 * | 5/2005 | Enrique | 297/184.16 |
| 6,908,154 | B2 | 6/2005 | Aono | |
| 7,614,414 | B2 | 11/2009 | Jamshidi | |

FOREIGN PATENT DOCUMENTS

| | | | |
|---|---|---|---|
| CN | 2768526 | | 4/2006 |
| CN | 201271345 | Y | 7/2009 |
| CN | 202085868 | | 12/2011 |
| JP | 3051536 | | 8/1998 |
| JP | H19-209590 | | 8/2007 |
| TW | 143769 | | 10/1990 |
| TW | 277239 | | 3/2007 |

OTHER PUBLICATIONS

European Search Report dated Apr. 9, 2015 regarding European Application No. 13178552.9 (7 pages).

* cited by examiner

WALKING STICK CHAIR

CROSS-REFERENCE TO RELATED APPLICATION

This application is a continuation-in-part (CIP) of co-pending U.S. patent application Ser. No. 13/831,566, filed on Mar. 14, 2013, which claims priority of Taiwanese Application No. 101127841, filed on Aug. 1, 2012, Taiwanese Application No. 101127837, filed on Aug. 1, 2012, and Taiwanese Application No. 101147797, filed on Dec. 17, 2012.

BACKGROUND OF THE INVENTION

1. Field of the Invention

The invention relates to a walking stick, more particularly to a foldable walking stick chair that is convertible between a walking stick and a chair.

2. Description of the Related Art

Elder people have inferior physical condition. Usually, they need to walk with a walking stick, and take a rest after walking for a period of time. Taiwanese Utility Model Patent No. 277239 discloses a conventional foldable walking stick chair including a main stick, a leg unit and a seat unit. The main stick has a handle portion and a foot portion opposite to the handle portion. The leg unit is connected pivotally to the main stick at a pivot point to form a scissors-like structure, and has a support end and a connecting end opposite to the support end. The seat unit includes a slider member connected slidably to the main stick between the handle portion and the pivot point, and a seat plate connected pivotally to the slider member and the connecting end of the leg unit to form a slider-crank mechanism.

When the conventional walking stick chair is unfolded to be utilized as a chair, the main stick and the leg unit form an angle, the support end of the leg unit cooperates with the foot portion of the main stick for supporting the entire walking stick chair, and the seat plate is horizontal and forms an angle with the main stick. When the conventional walking stick chair is folded to be utilized as a walking stick, the slider member is moved upwardly toward the handle portion, the seat plate pivots downwardly relative to the slider member to be close to the main stick, and the leg unit pivots toward the main stick to reduce the angle between the leg unit and the main stick. At the folded state, the support end of the leg unit is lifted from the ground.

Despite being operable between a folded state and an unfolded state, the abovementioned walking stick chair has several disadvantages:

1. When the walking stick chair serves as a walking stick at the folded state, the support end of the leg unit is still proximate to the ground. If the ground is uneven, the support end may hit a projecting portion of the ground. Moreover, since the leg unit is X-shaped, a user may easily stumble on the leg unit when using the conventional walking stick chair as a walking stick.

2. In the folded state, the center of gravity of the walking stick chair is distal from the handle portion, so that the walking stick chair is laborious for the user when being used as a walking stick.

U.S. Pat. No. 3,999,565, U.S. Pat. No. 2,380,437, and U.S. Pat. No. 7,614,414 have disadvantages similar to the abovementioned walking stick chair.

SUMMARY OF THE INVENTION

Therefore, the object of the present invention is to provide a walking stick chair that is labor-saving and safe when serving as a walking stick.

Accordingly, a walking stick chair of the present invention comprises:

a main stick having an elongated rod body that has opposite upper and lower ends, a handle portion that is connected to the upper end of the rod body, and a foot portion that is connected to the lower end of the rod body;

a seat unit including an upper slider member that is connected slidably to the rod body and that is movable along the rod body between a first position and a second position, the second position being distal from the handle portion, the first position being located between the handle portion and the second position, and a seat member that is connected to the upper slider member;

a support unit having a pivoted end portion that is connected pivotally to the rod body under the upper slider member of the seat unit, and a free end portion opposite to the pivoted end portion; and a linking unit disposed between and connected pivotally to the support unit and the seat unit;

wherein, when the upper slider member is at the second position, the seat member is at an unfolded state where the seat member and the rod body form an angle, and the support unit is at an unfolded state where the free end portion of the support unit is away from the rod body and cooperates with the foot portion for contacting ground; and wherein, when the upper slider member moves upwardly from the second position to the first position, the seat member moves toward the rod body to a folded state, and the linking unit is driven to move upwardly to actuate the support unit to pivot upwardly to a folded state where the free end portion is close to the rod body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
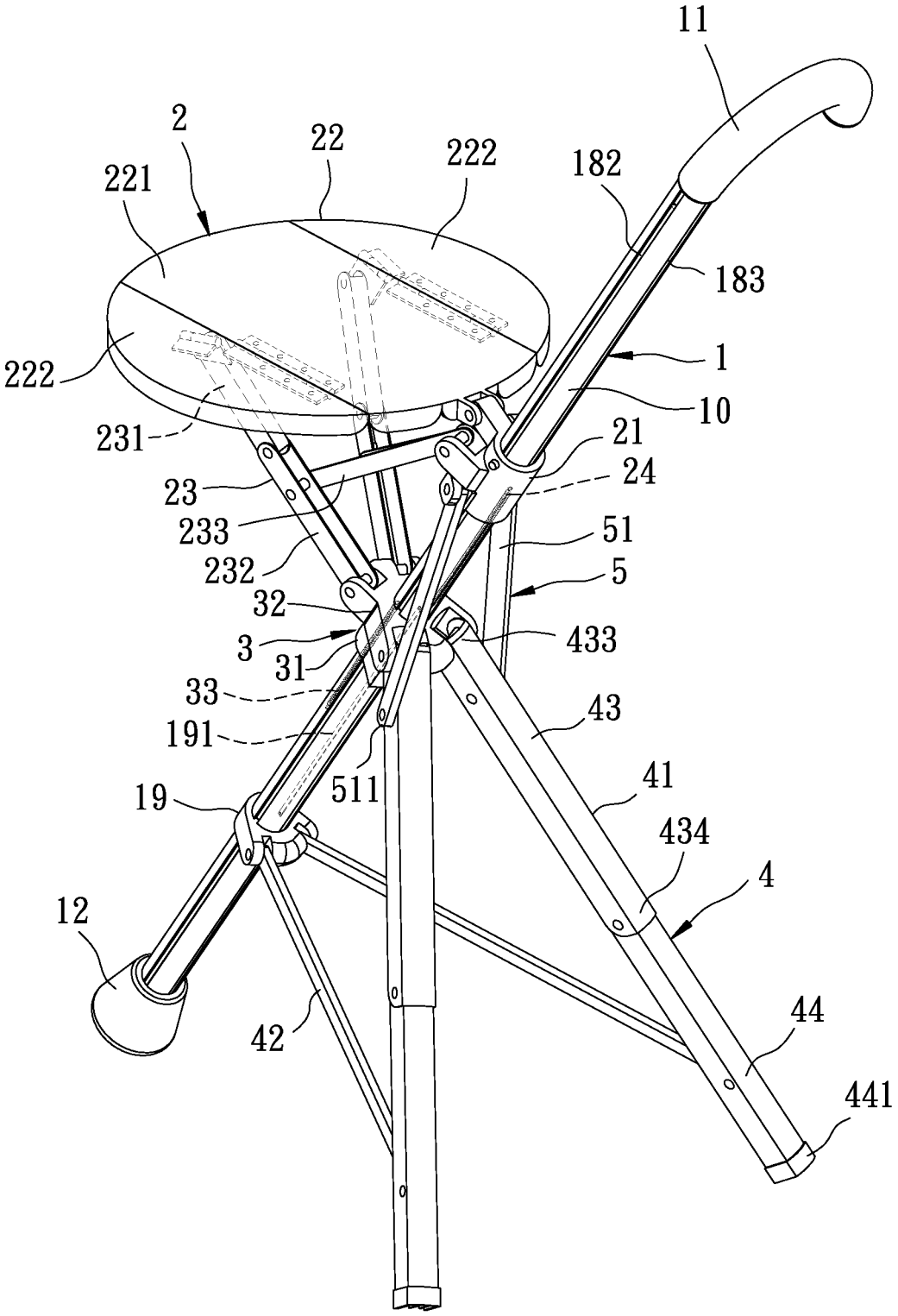
FIG. 1 is a perspective view of a first preferred embodiment of a walking stick chair according to the invention at an unfolded state.
Figure 2:
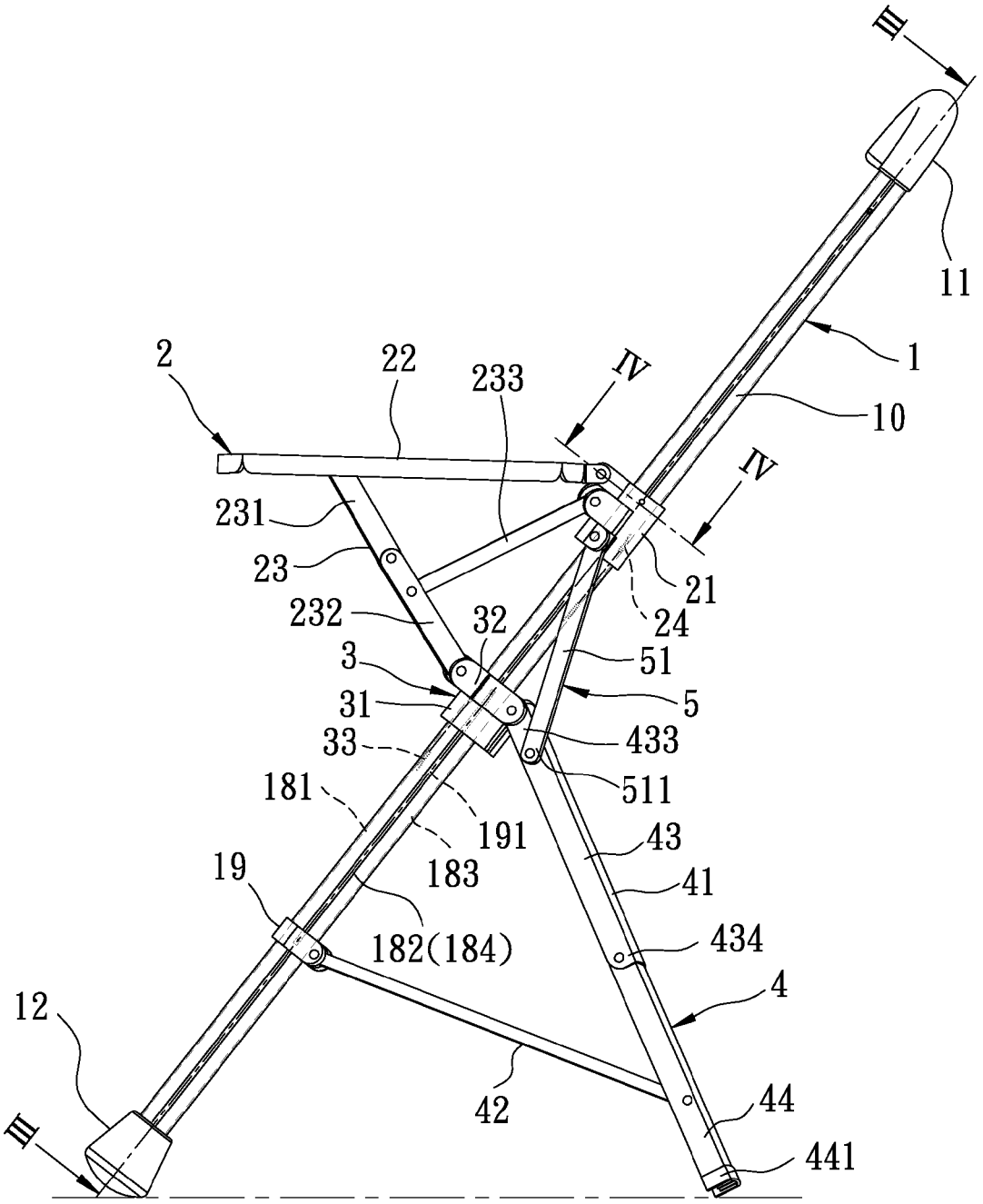
FIG. 2 is a side view of the first preferred embodiment at the unfolded state.

As shown in FIGS. 1 and 2, a first preferred embodiment of a walking stick chair according to the present invention comprises a main stick 1, a seat unit 2, a positioning unit 3, a support unit 4, and a linking unit 5.

The main stick 1 has an elongated rod body 10 that has opposite upper and lower ends, a hook-shaped handle portion 11 that is connected to the upper end of the rod body 10, a foot portion 12 that is connected to the lower end of the rod body 10, and a plurality of angularly spaced-apart grooves 181, 182, 183, 184 (see FIG. 4) that are formed in an outer surface of the rod body 10 and that extend in a longitudinal direction of the rod body 10.

Figure 3:
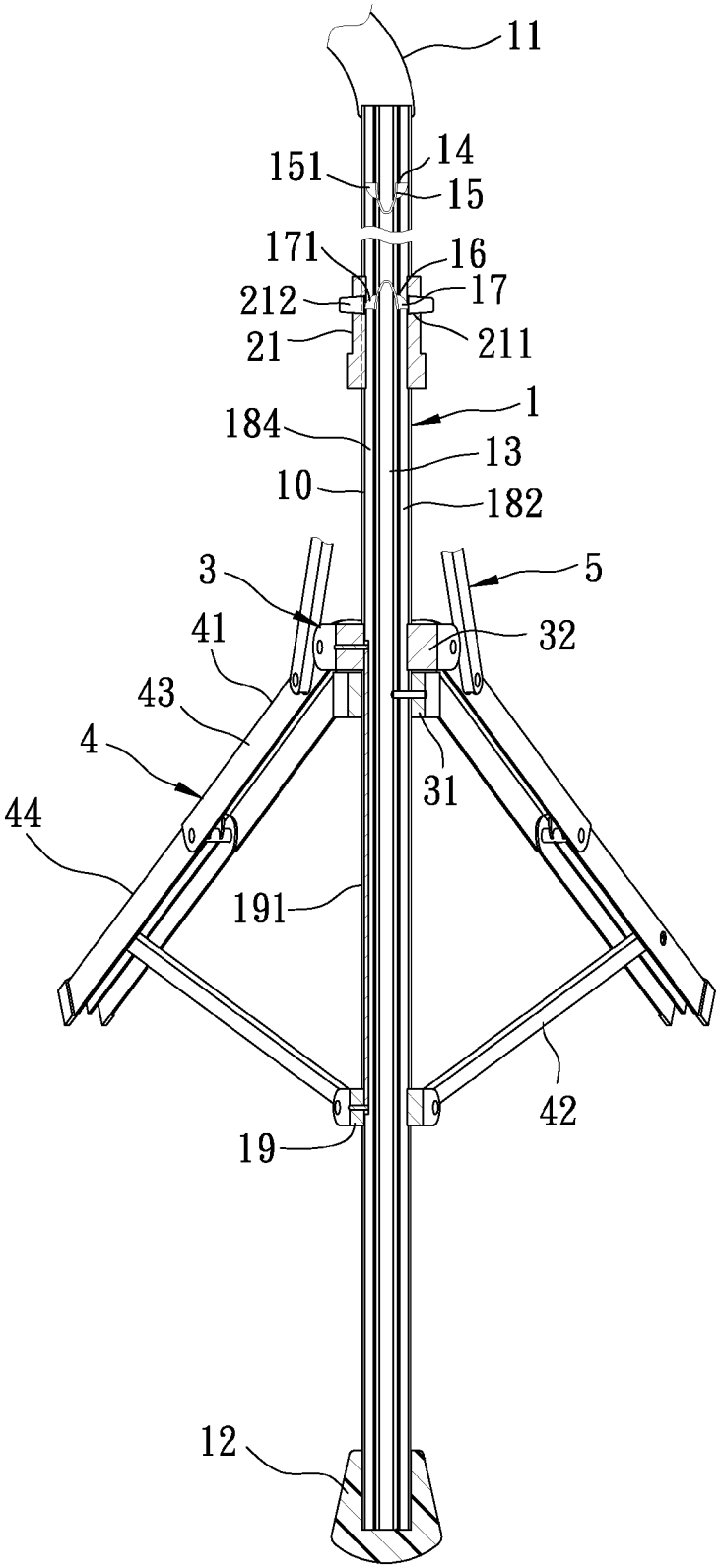
FIG. 3 is a fragmentary partly sectional view of the first preferred embodiment taken along line III-III in FIG. 2.
Figure 4:
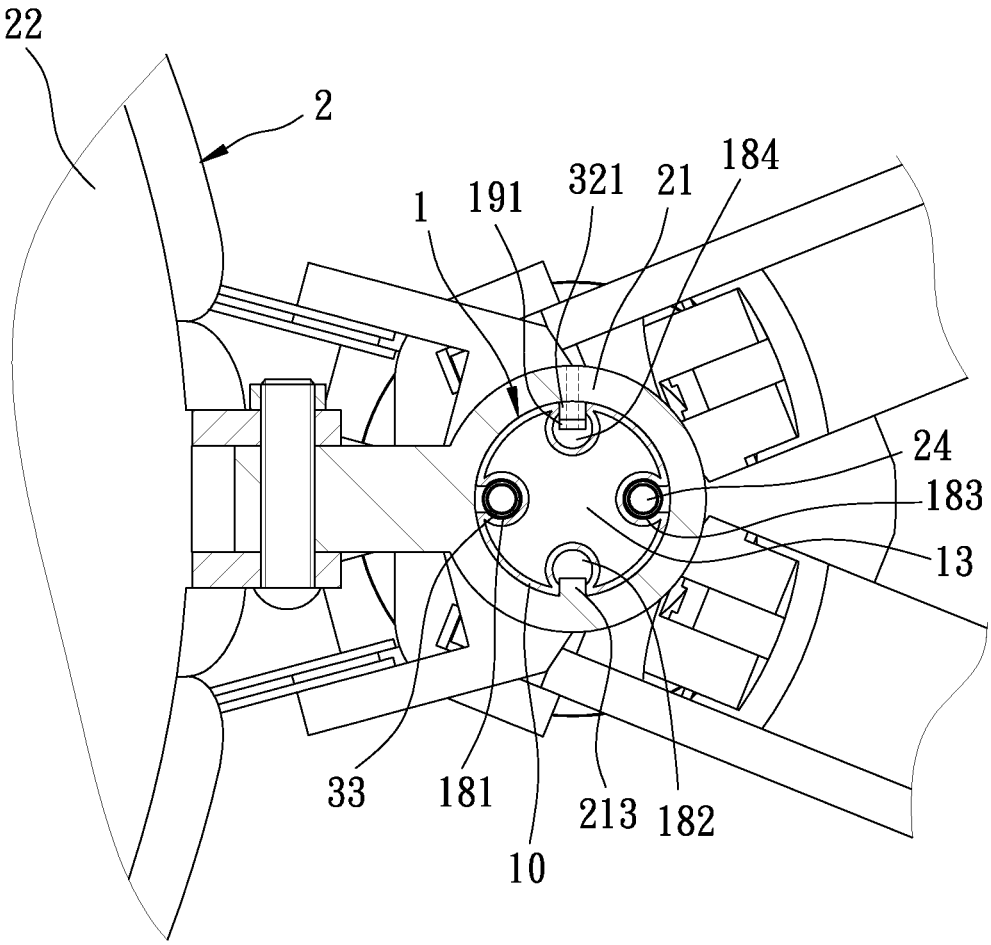
FIG. 4 is a fragmentary sectional view of the first preferred embodiment taken along line IV-IV in FIG. 2.

As shown in FIGS. 3 and 4, the rod body 10 is tubular and formed by a rod body wall with a thickness shorter than depths of the grooves 181, 182, 183, 184. The rod body 10 has a central space 13, a pair of upper through holes 14 communicating spatially and respectively with the central space 13 and two of the grooves 182, 184 and formed near the handle portion 11, and a pair of lower through holes 16 communicating spatially and respectively with the central space 13 and the two of the grooves 182, 184 and formed below the upper through holes 14. The main stick 1 further has an upper resilient bow member 15 that is disposed in the rod body 10 and that has a pair of upper projections 151 projecting retractably and respectively through the upper through holes 14, and a lower resilient bow member 17 that is disposed in the rod body 10 and that has a pair of lower projections 171 projecting retractably and respectively through the lower through holes 16. The configuration of the grooves 181, 182, 183, 184 enhances the structural strength of the rod body 10.

The seat unit 2 includes an upper slider member 21 that is connected slidably to the rod body 10, a seat member 22 that is connected pivotally to the upper slider member 21, and a resilient member 24 connected between the upper slider member 21 and the rod body 10 for biasing the upper slider member 21 toward the foot portion 12. The upper slider member 21 is movable along the rod body 10 between a first position (see FIG. 6) and a second position (see FIG. 2). The second position is distal from the handle portion 11, and the first position is located between the handle portion 11 and the second position. The upper slider member 21 is sleeved on the rod body 10, and has a pair of through holes 211 corresponding in angular position to the two of the grooves 182, 184 of the rod body 10 for extension of the upper projections 151 so as to position the upper slider member 21 relative to the rod body 10. The upper slider member 21 further has a pair of button members 212 installed slidably and respectively in the through holes 211, and operable to press inwardly the upper projections 151 and disengage the upper projections 151 from the through holes 211 so as to permit the movement of the upper slider member 21 between the first and second positions. The upper slider member 21 further has a guide block 213 engaging slidably the groove 182 for preventing rotation of the upper slider member 21 relative to the rod body 10. The resilient member 24 is disposed in another groove 183.

Figure 9:
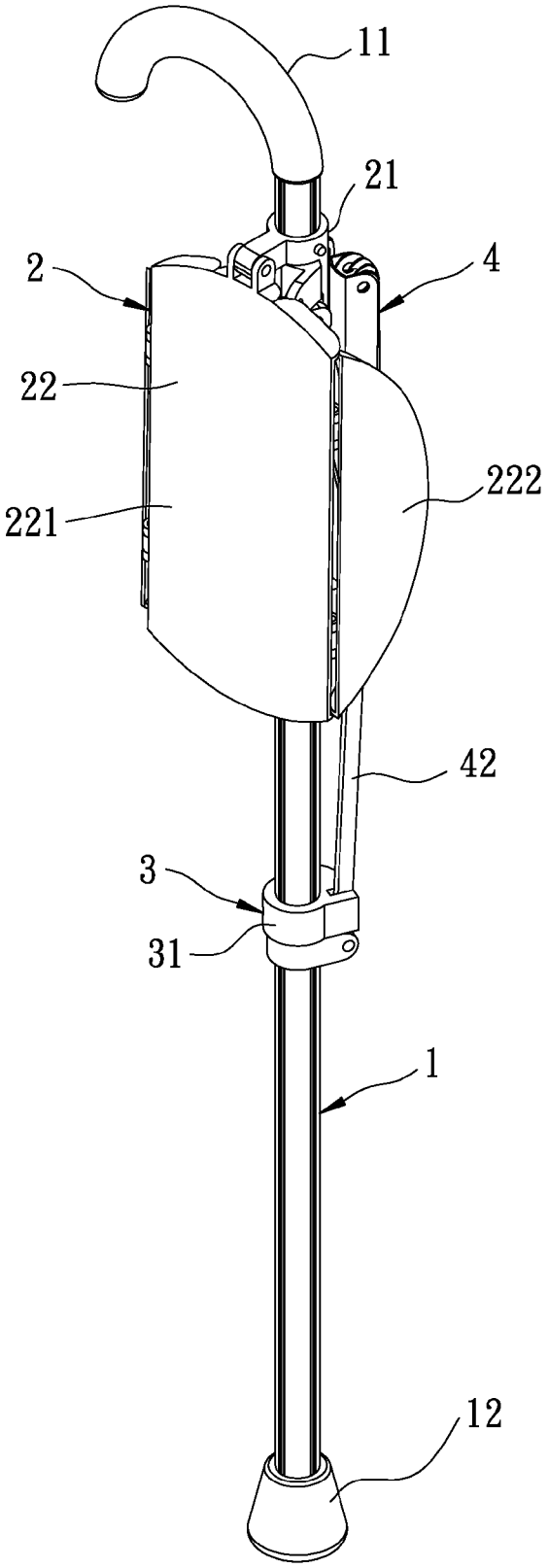
FIG. 9 is a perspective view of the first preferred embodiment at the folded state.
Figure 10:
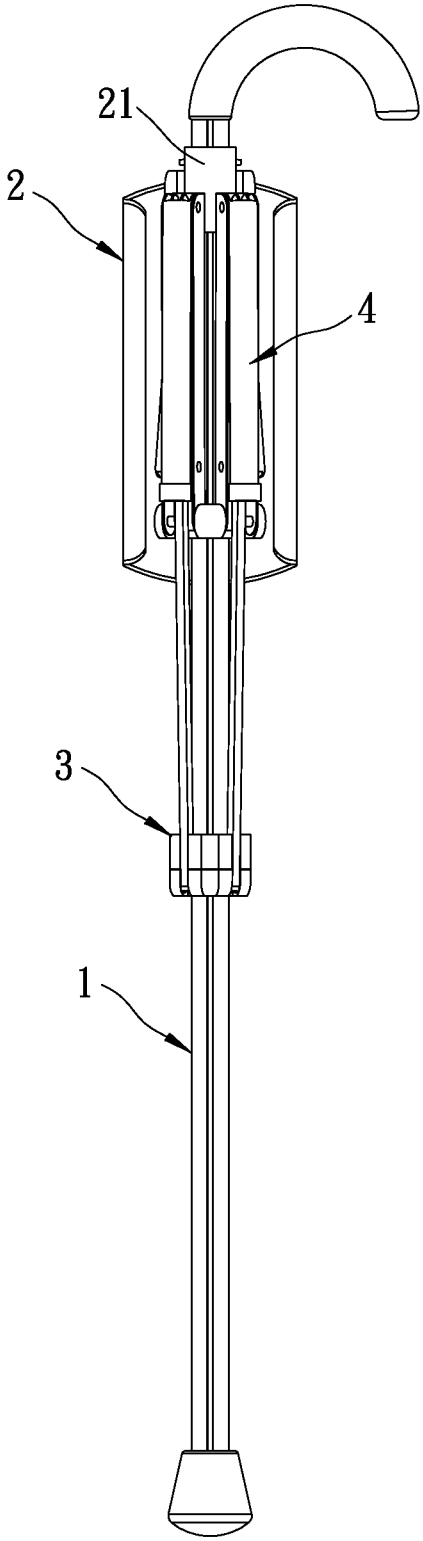
FIG. 10 is still another side view of the first preferred embodiment at the folded state.

The seat member 22 includes a main plate 221 and a pair of lateral plates 222 connected respectively to opposite lateral edges of the main plate 221 and pivotable relative to the main plate 211 to a folded state (see FIG. 9).

In this embodiment, the positioning unit 3 includes an abutment member 31 connected immovably to the rod body 10 under the upper slider member 21, a middle slider member 32 connected slidably to the rod body 10 and disposed between the abutment member 31 and the upper slider member 21, and a resilient member 33 connected between the middle slider member 32 and the rod body 10 for biasing the middle slider member 32 toward the abutment member 31. The middle slider member 32 has a guide block 321 engaging slidably the groove 184 for limiting rotation of the middle slider member 32 relative to the rod body 10. The resilient member 33 is disposed in the groove 181. The positioning unit 3 further includes a lower slider member 19 connected slidably to the rod body 10 and disposed between the middle slider member 32 and the foot portion 12, and a connecting rod 191 disposed slidably in the groove 184 and interconnecting co-movably the lower and middle slider members 19, 32.

The seat unit 2 further includes a pair of linkage sets 23, each of which is disposed between and connected pivotally to the seat member 22 and the positioning unit 3. In this embodiment, each of the linkage sets 23 includes first, second and third bars 231, 232, 233. For each linkage sets 23, the first bar 231 has one end connected pivotally to the seat member 22, and another end connected pivotally to one end of the second bar 232, the second bar 232 has another end connected pivotally to the middle slider member 32, and the third bar 233 has opposite ends connected pivotally and respectively to the second bar 232 and the upper slider member 21.

The support unit 4 includes a pair of support legs 41, each of which has an upper leg component 43 and a lower leg component 44. The upper leg component 43 has a pivoted end portion 433 connected pivotally to the middle slider member 32, and the lower leg component 44 has a free end portion 441 and an opposite end portion connected pivotally to an opposite end portion 434 of the upper leg component 43 oppositely of the pivoted end portion 433. The support unit 4 further includes a pair of auxiliary linkages 42, each of which has an end connected pivotally to the lower slider member 19 and an opposite end connected pivotally to a respective one of the lower leg components 44.

The linking unit 5 is disposed between and connected pivotally to the support unit 4 and the seat unit 2. In this embodiment, the linking unit 5 includes a pair of linking members 51, each of which has an end serving as a driven portion connected pivotally to the upper slider member 21 and an opposite end 511 serving as a driving portion connected pivotally to the upper leg component 43 of a respective one of the support legs 4. Each of the linking members 51 is connected to the respective upper leg component 43 at a pivot point between the corresponding pivoted end portion 433 and the corresponding lower leg component 44. Each of the linking members 51 has a length larger than a distance between the pivot point and the pivoted end portion 433 of the respective upper leg component 43.

When the upper slider member 21 is at the second position with the lower projections 171 of the lower resilient bow member 17 extending respectively into the through holes 211 of the upper slider member 21, the seat member 22 is at an unfolded state where the seat member 22 and the rod body 10 form an angle and the main plate 221 and the lateral plates 222 form a flat plate, the middle slider member 32 abuts against the abutment member 31, and the support legs 41 are at an unfolded state where the free end portions 441 are away from the rod body 10 of the main stick 1 and cooperate with the foot portion 12 of the main stick 1 for contacting ground (i.e., the walking stick chair is at an unfolded state, see FIGS. 1 and 2).

Figure 5:
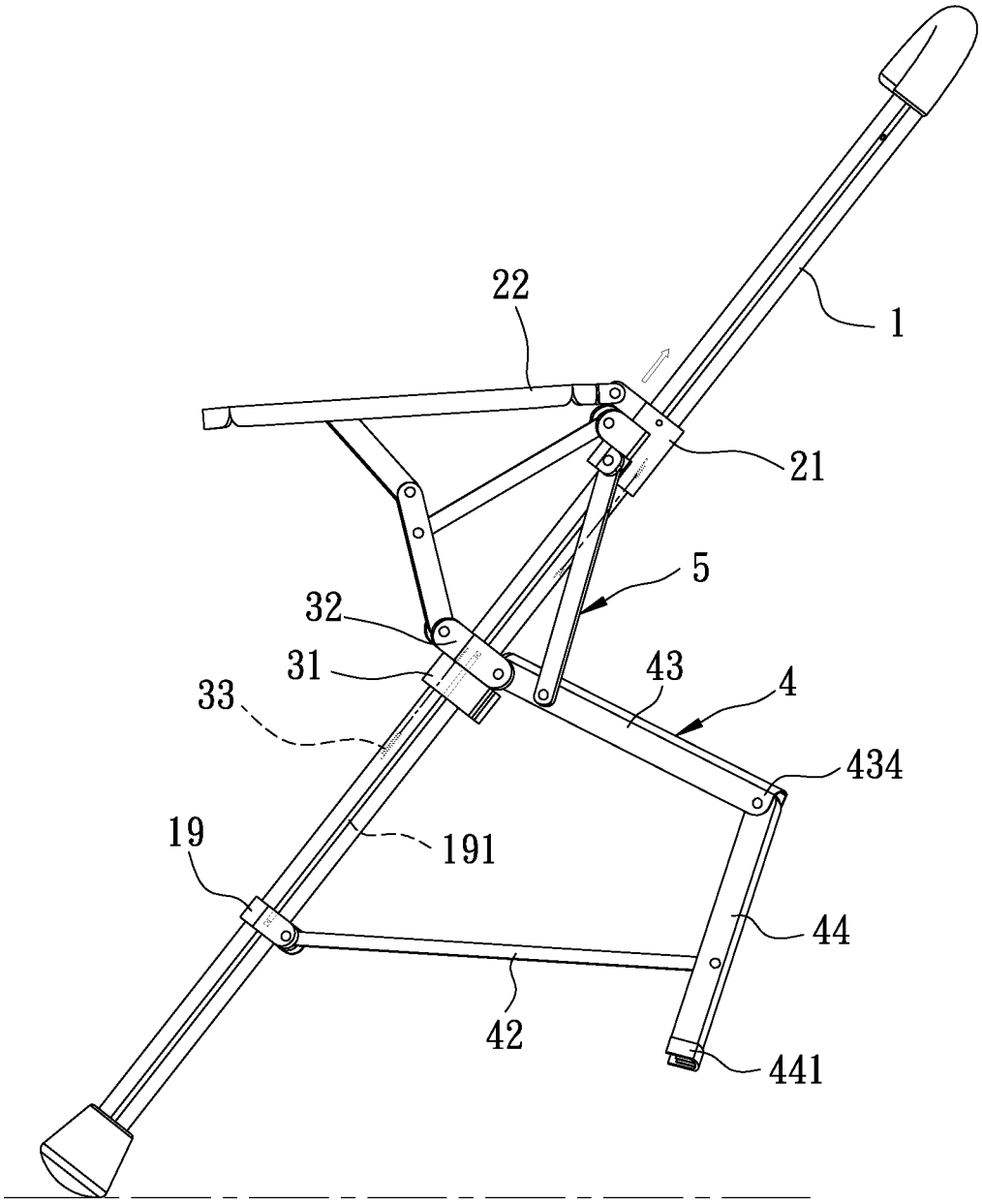
FIG. 5 is another side view of the first preferred embodiment beginning to be folded.
Figure 6:
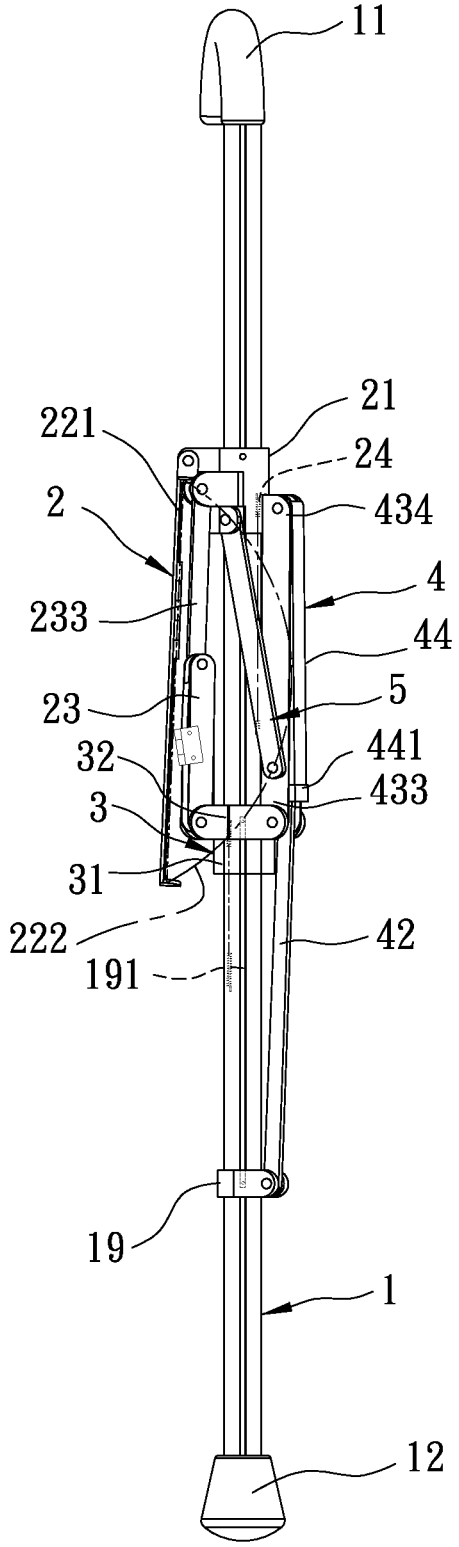
FIG. 6 is another side view of the first preferred embodiment in the process of being folded.
Figure 7:
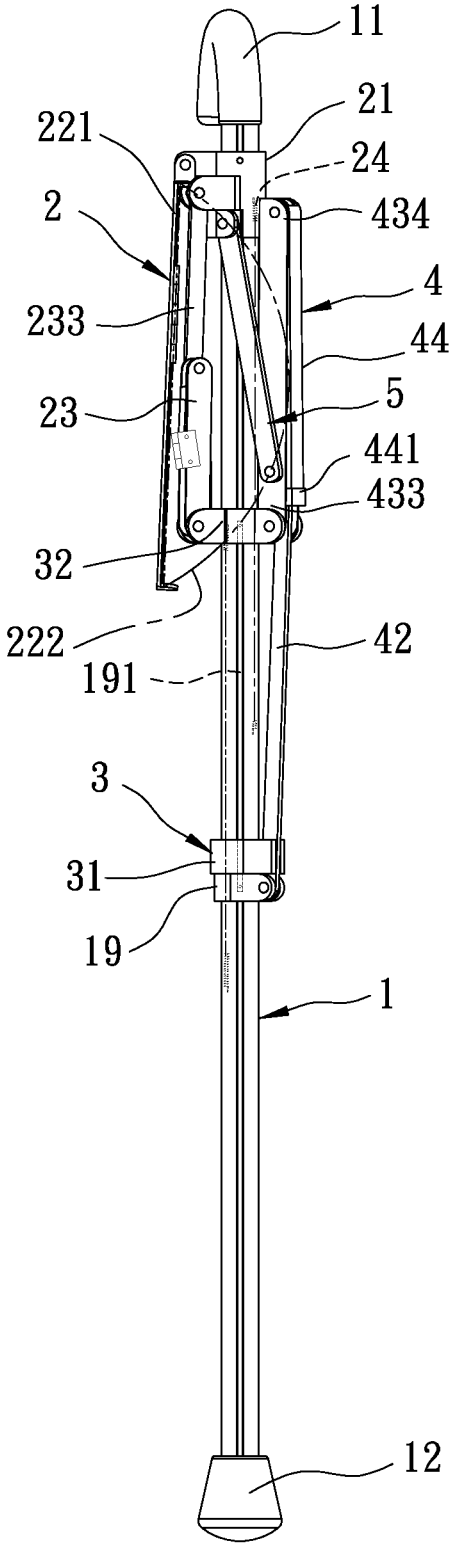
FIG. 7 is another side view of the first preferred embodiment at a folded state.
Figure 8:
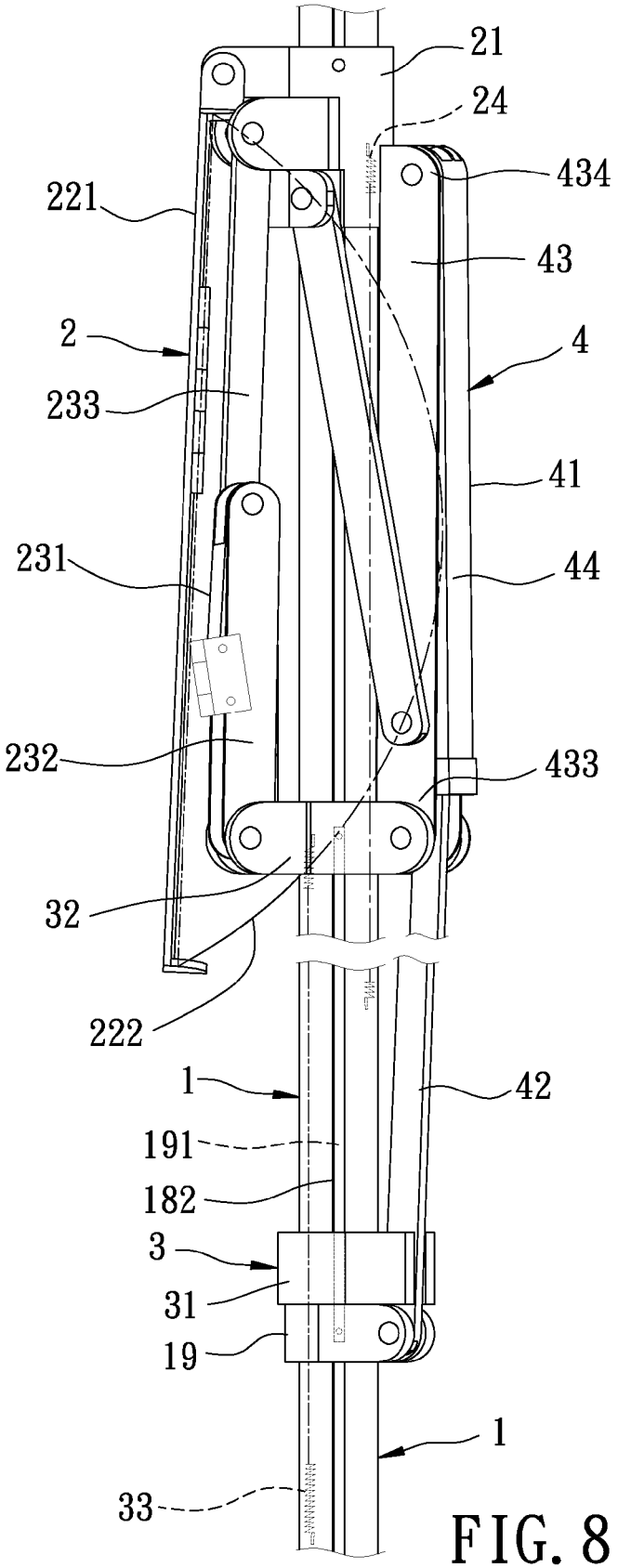
FIG. 8 is an enlarged fragmentary perspective view of the first preferred embodiment at the folded state.

When the walking stick chair of this embodiment serves as a chair, the upper slider member 21 is at the second position and the through holes 211 of the upper slider member 21 engage respectively the lower projections 171 of the lower resilient bow member 17. To collapse the walking stick chair, as shown in FIGS. 5 and 6, the button members 212 of the upper slider member 21 are pressed to disengage the lower projections 171 from the through holes 211 of the upper slider member 21, so that the upper slider member 21 is allowed to move upwardly against the resilient member 24. Since the resilient member 33 biases the middle slider member 32 toward the abutment member 31 and the connecting rod 191 interconnects co-movably the middle and bottom slider members 32, 19, when the upper slider member 21 is moved upwardly from the second position to the first position, the middle and bottom slider members 32, 19, and the connecting rod 191 are temporarily held immovably by the resilient member 33. During the abovementioned upward movement of the upper slider member 21, each third bar 233 is driven to move upwardly and drives a corresponding second bar 232 to pivot upwardly, the corresponding second bar 232 thus drives a corresponding first bar 231 to pivot downwardly relative thereto to therefore drive the seat member 22 to pivot downwardly and toward the rod body 10 to move to the folded state. Meanwhile, the linkage sets 23 convert to a folded state, the linking members 51 are driven by the upper slider member 21 to move upwardly to actuate the upper leg components 43 to pivot upwardly, and the auxiliary linkages 42 actuate the lower leg components 44 to pivot downwardly so that the support legs 41 convert to a folded state where the free end portions 441 are close to the rod body 10 (see FIG. 6).

After the seat member 22, the linkage sets 23 and the support legs 41 are driven to their folded states, the upper slider member 21 can be further moved from the first position to an uppermost position (see FIGS. 7 to 10) and drives the seat member 22, the linkage sets 23, the middle slider member 32, the support unit 4, and the linking unit 5 to move upwardly therewith to thereby complete the conversion of this embodiment into a walking stick (i.e., the walking stick chair is at an folded state, see FIGS. 7 to 10). As a result, the center of gravity of the walking stick chair is relatively close to the handle portion 11.

To sum up, when the first preferred embodiment is at the folded state to serve as a walking stick, since the center of gravity thereof is close to the handle portion 11, walking with such a walking stick is labor-saving for a user. On the other hand, since the support legs 41 pivot upwardly when being folded, the free end portions 441 are close to the rod body 10 and away from the foot portion 12 when the support legs 41 are at the folded state. Therefore, the free end portions 441 would not hit a projecting portion of the ground, and the user would not stumble on the support legs 41.

Figure 11:
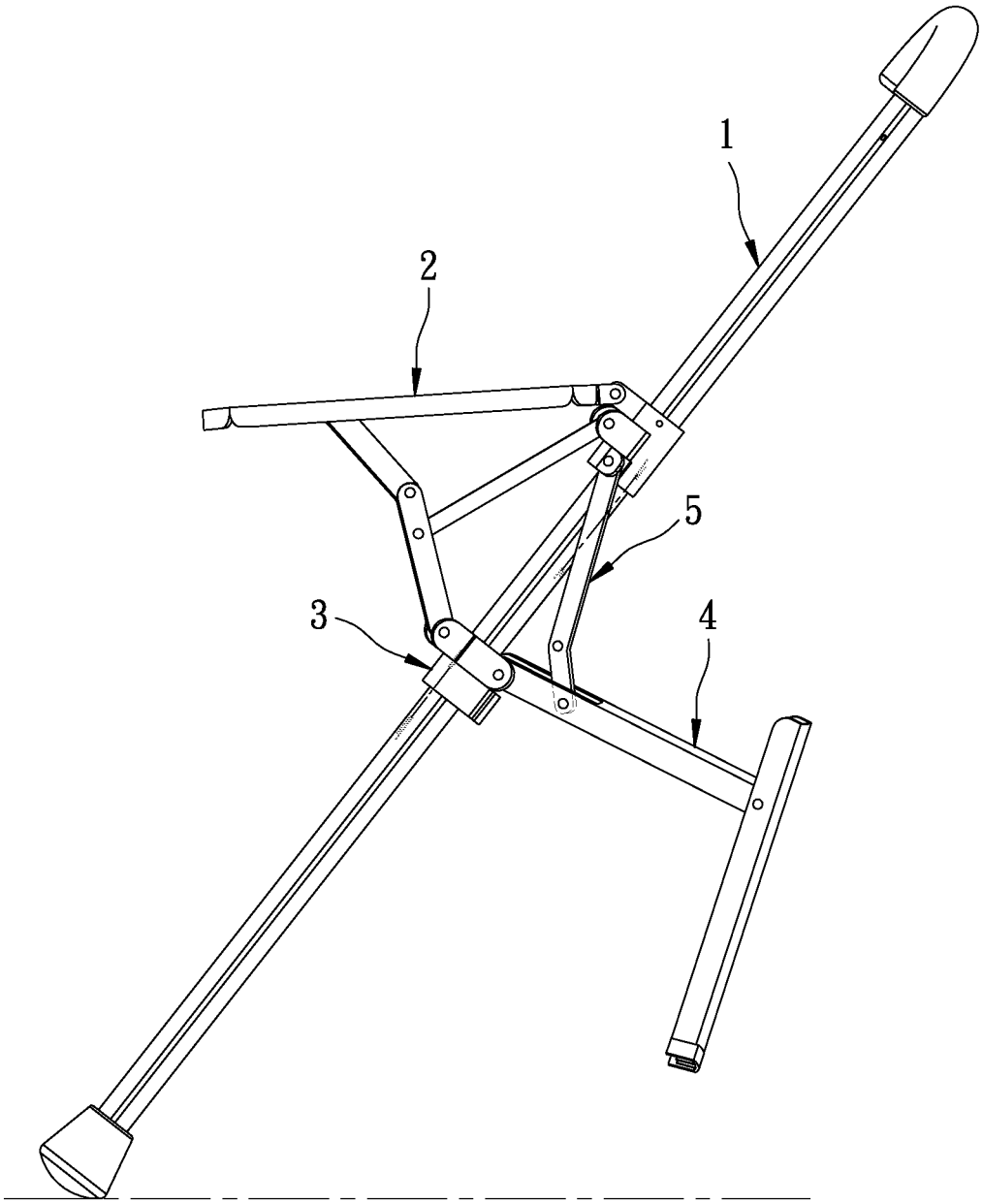
FIG. 11 is a side view of a variation of the first preferred embodiment.

FIG. 11 illustrates a variation of the first preferred embodiment, in which the connecting rod 191, the lower slider member 19 and the auxiliary linkages 42 are omitted.

Figure 12:
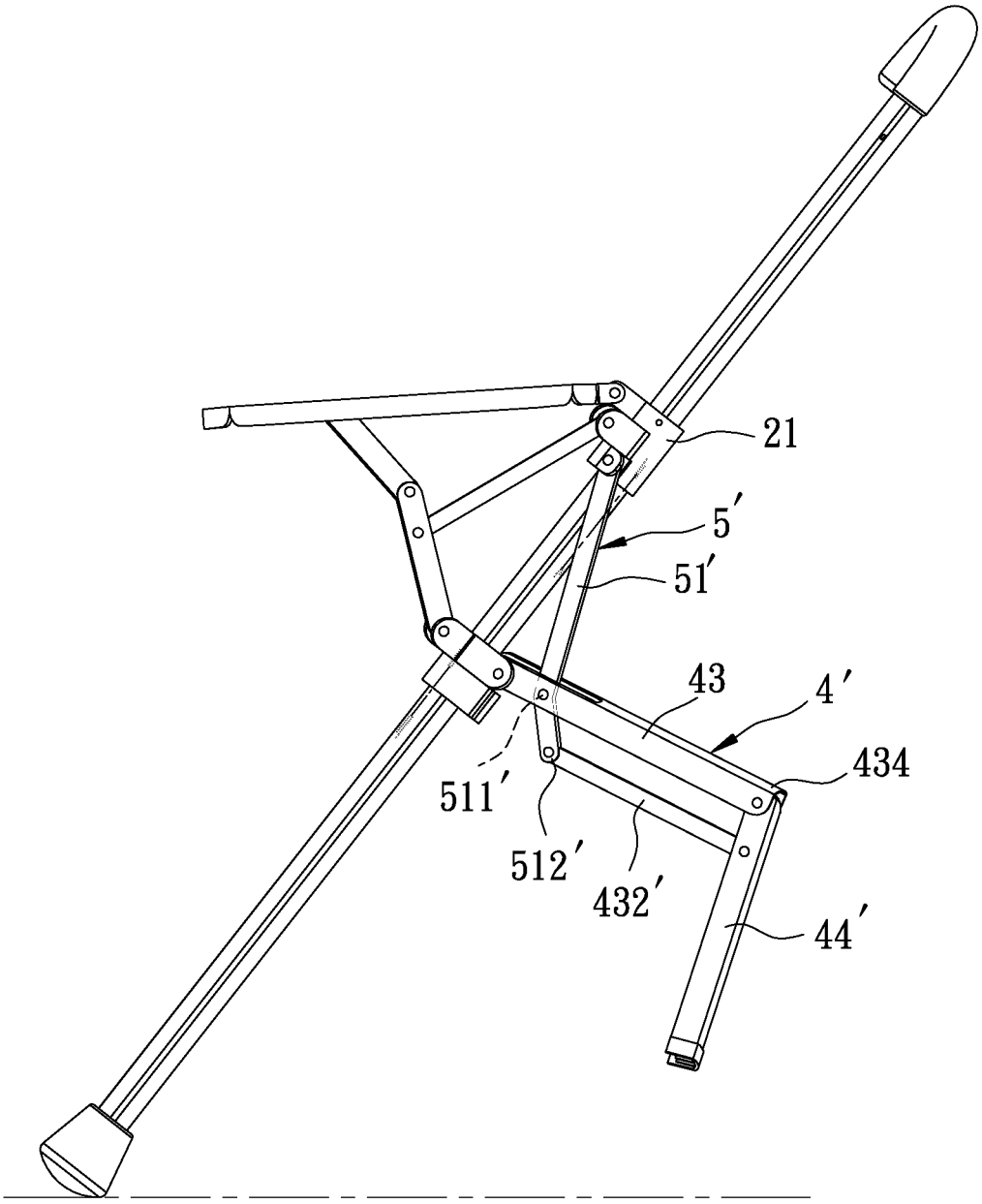
FIG. 12 is a side view of another variation of the first preferred embodiment.

Referring to FIG. 12, another variation of the first preferred embodiment also omits the connecting rod 191, the lower slider member 19 and the auxiliary linkages 42 in the first preferred embodiment. Each linking member 51' of the linking unit 5' has one end serving as the driven portion and connected to the upper slider member 21, an opposite end 512' opposite to the one end, and an intermediate portion 511' between the one end and the opposite end 512' connected pivotally to a respective one of the upper leg components 43. The intermediate portion 511' and the opposite end 512' serve as the driving portion. The support unit 4' further includes a pair of sub-leg components 432'. Each of the sub-leg components 432' is substantially parallel to a respective one of the upper leg components 43, and has one end connected pivotally to the opposite end 512' of a corresponding one of the linking members 51' and an opposite end connected pivotally to a corresponding one of the lower leg components 44'. It should be noted that only one linking member 51', one upper leg component 43, one lower leg component 44' and one sub-leg component 432' are visible in FIG. 12. When the upper slider member 21 is moved upwardly from the second position to the first position, each linking member 51' is driven to move upwardly and drives a corresponding upper leg component 43 to pivot upwardly, simultaneously, the opposite end 512' thereof drives a corresponding lower leg component 44' to pivot downwardly to the folded state via a corresponding sub-leg component 432'.

Figure 13:
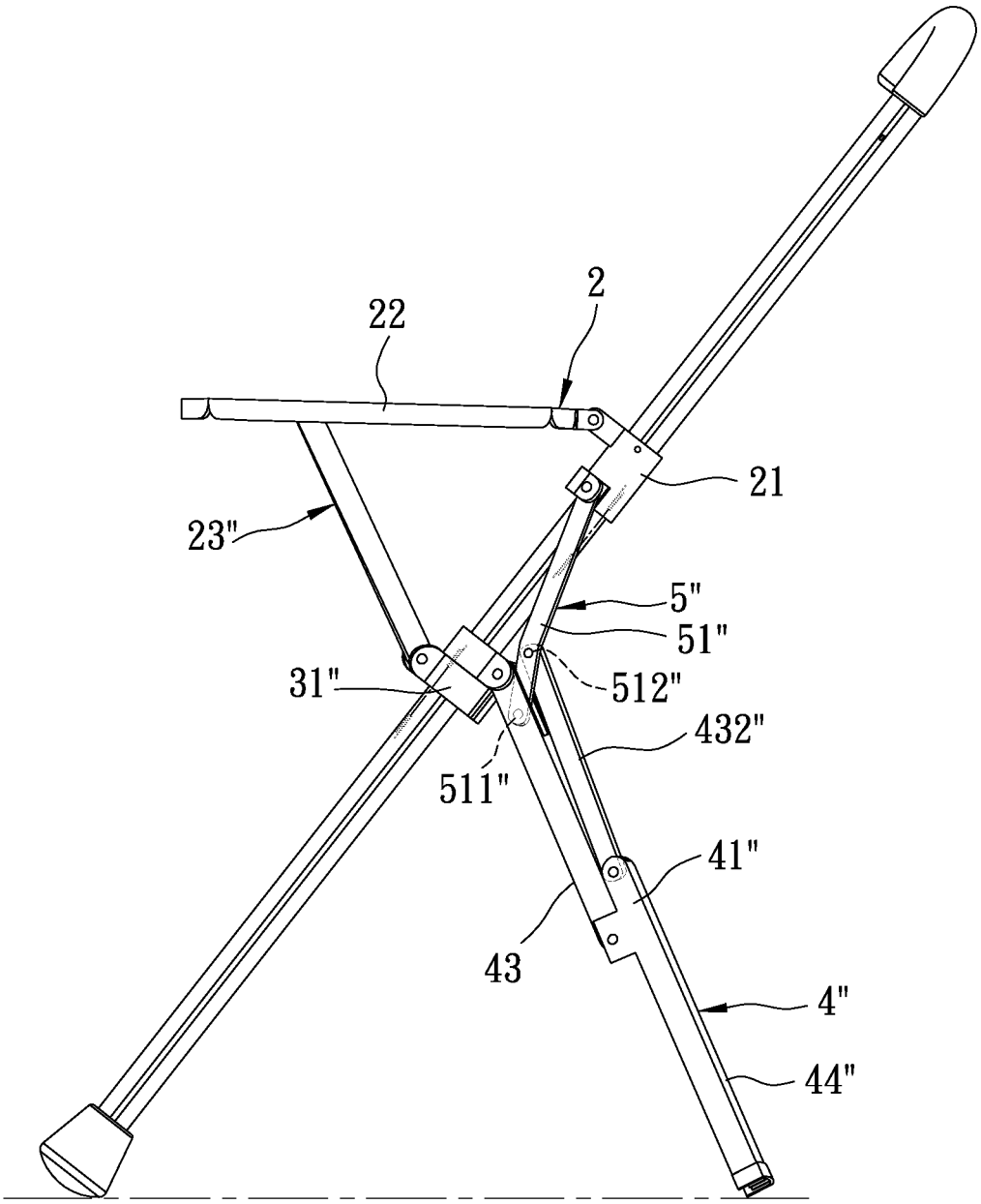
FIG. 13 is a side view of a second preferred embodiment according to the invention.

Referring to FIG. 13, a second preferred embodiment of this invention differs from the first preferred embodiment in that the connecting rod 191, the lower slider member 19 and the auxiliary linkages 42 are omitted, and that each of the linkage sets 23" is configured as a single bar that has opposite ends connected pivotally and respectively to the seat member 22" and the abutment member 31". Each of the linking members 51" of the linking unit 5" has one end serving as the driven portion and connected to the upper slider member 21, an opposite end 511" opposite to the one end and connected pivotally to a respective one of the upper leg components 43, and an intermediate portion 512" between the one end and the opposite end 511". The intermediate portion 512" and the opposite end 511" serve as the driving portion. The support unit 4" further includes a pair of sub-leg components 432". Each sub-leg components 432" is substantially parallel to a respective one of the upper leg components 43 and has one end connected pivotally to the intermediate portion 512" of a corresponding linking member 51" and another end connected pivotally to the lower leg component 44" of a corresponding support leg 41". The end portions of the linking members 51" connected to the upper slider member 21 may be connected to the seat member 22 of the seat unit 2.

Figure 14:
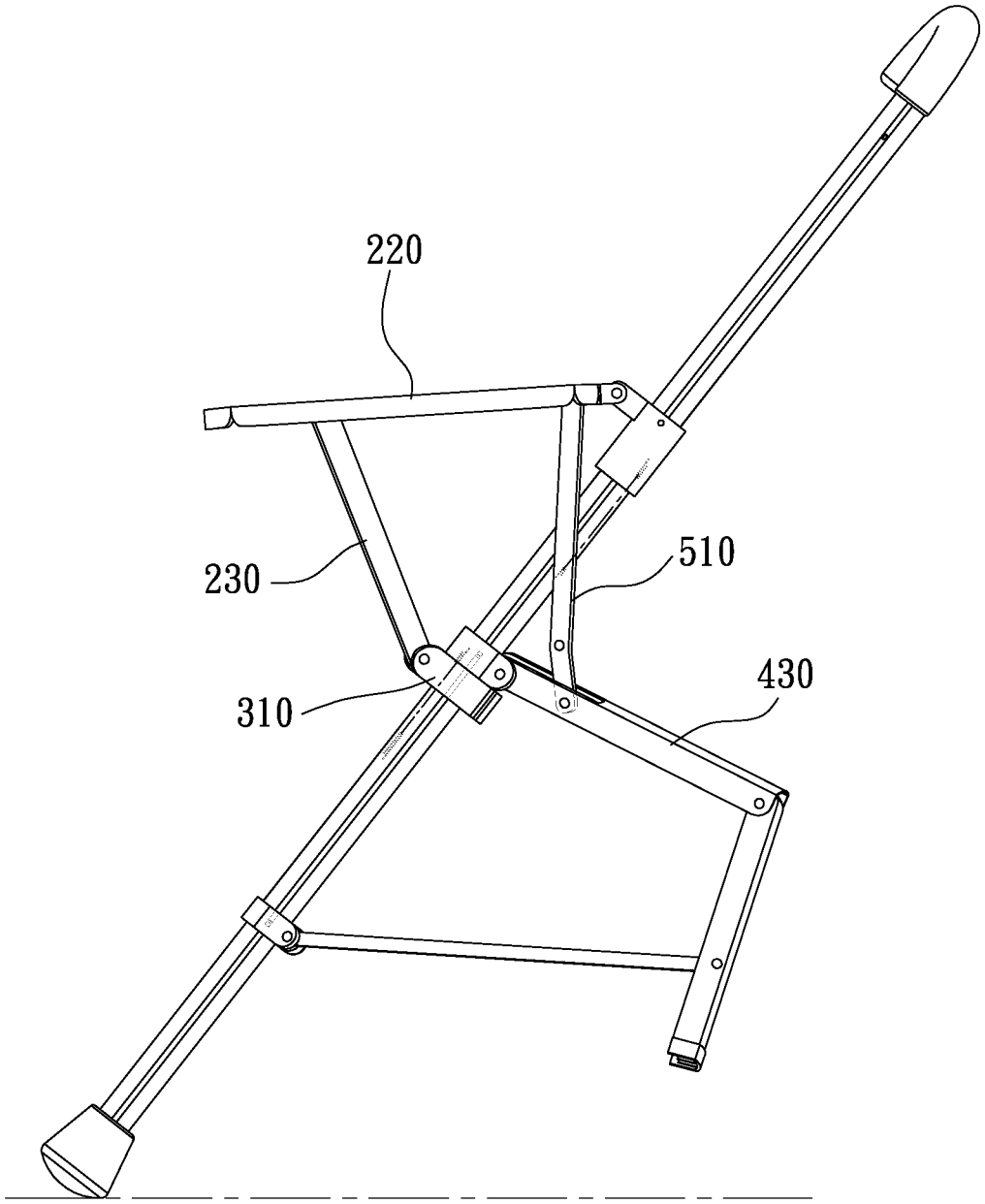
FIG. 14 is a side view of a third preferred embodiment according to the invention.

Referring to FIG. 14, a third preferred embodiment of this invention differs from the first preferred embodiment in that each of the linkage sets 230 is configured as a single bar that has opposite ends connected pivotally and respectively to the seat member 220 and the abutment member 310, and that each linking member 510 is connected pivotally between the respective upper leg component 430 and the seat member 220.

Figure 15:
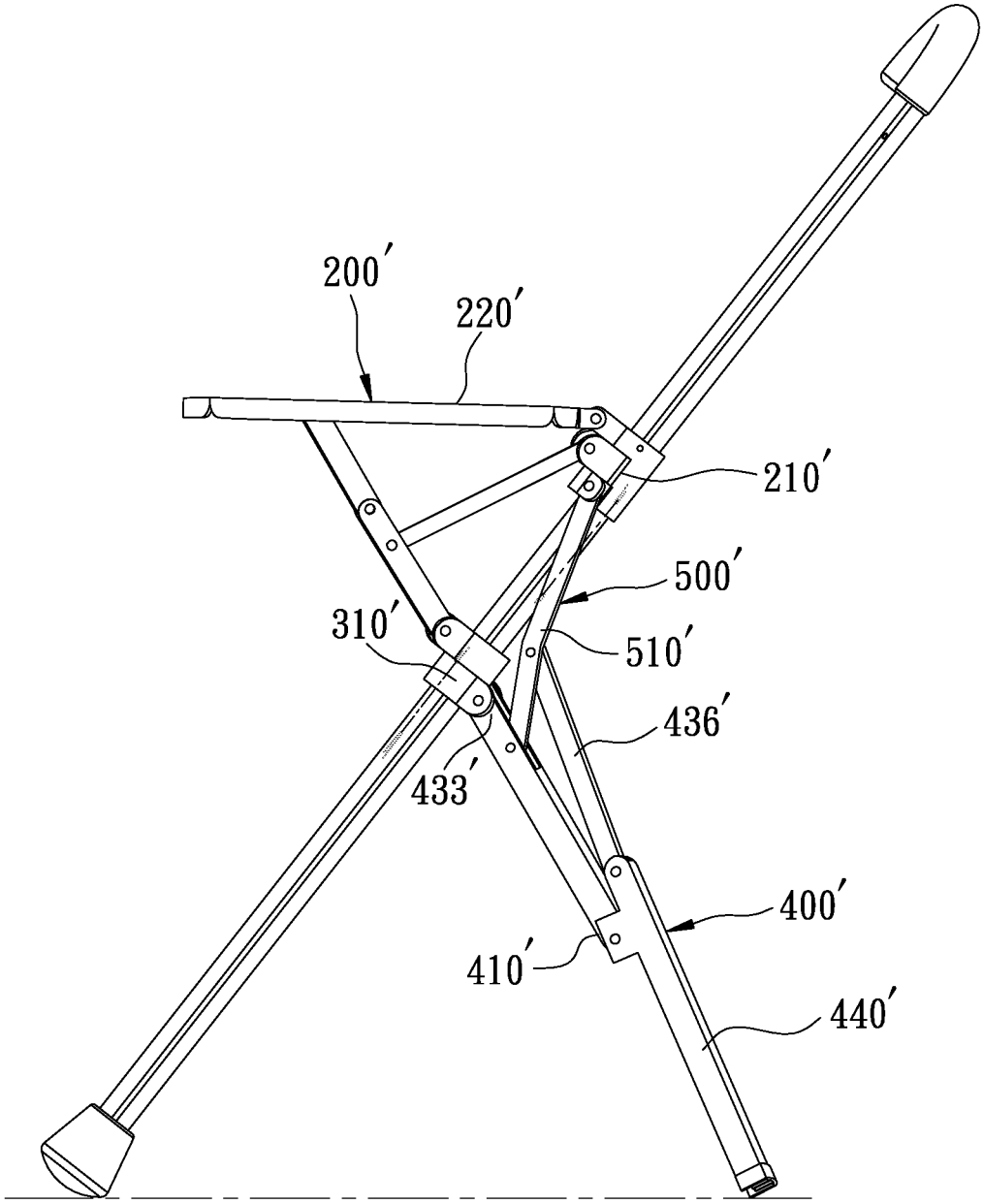
FIG. 15 is a side view of a fourth preferred embodiment according to the invention.

Referring to FIG. 15, a fourth preferred embodiment according to the invention omits the connecting rod 191, the lower slider member 19 and the auxiliary linkages 42 in the first preferred embodiment. The pivoted end portion 433' of each support leg 410' of the support unit 400' is connected pivotally to the abutment member 310'. The support unit 400' further includes a pair of sub-leg components 436'. Each sub-leg component 436' has one end connected pivotally to the respective linking member 510' of the linking unit 500' and another end connected pivotally to the respective lower leg component 440'. In this embodiment, an end of each of the linking member 510' connected to the upper slider member 210' may be connected to the seat member 220' of the seat unit 200'.

Figure 16:
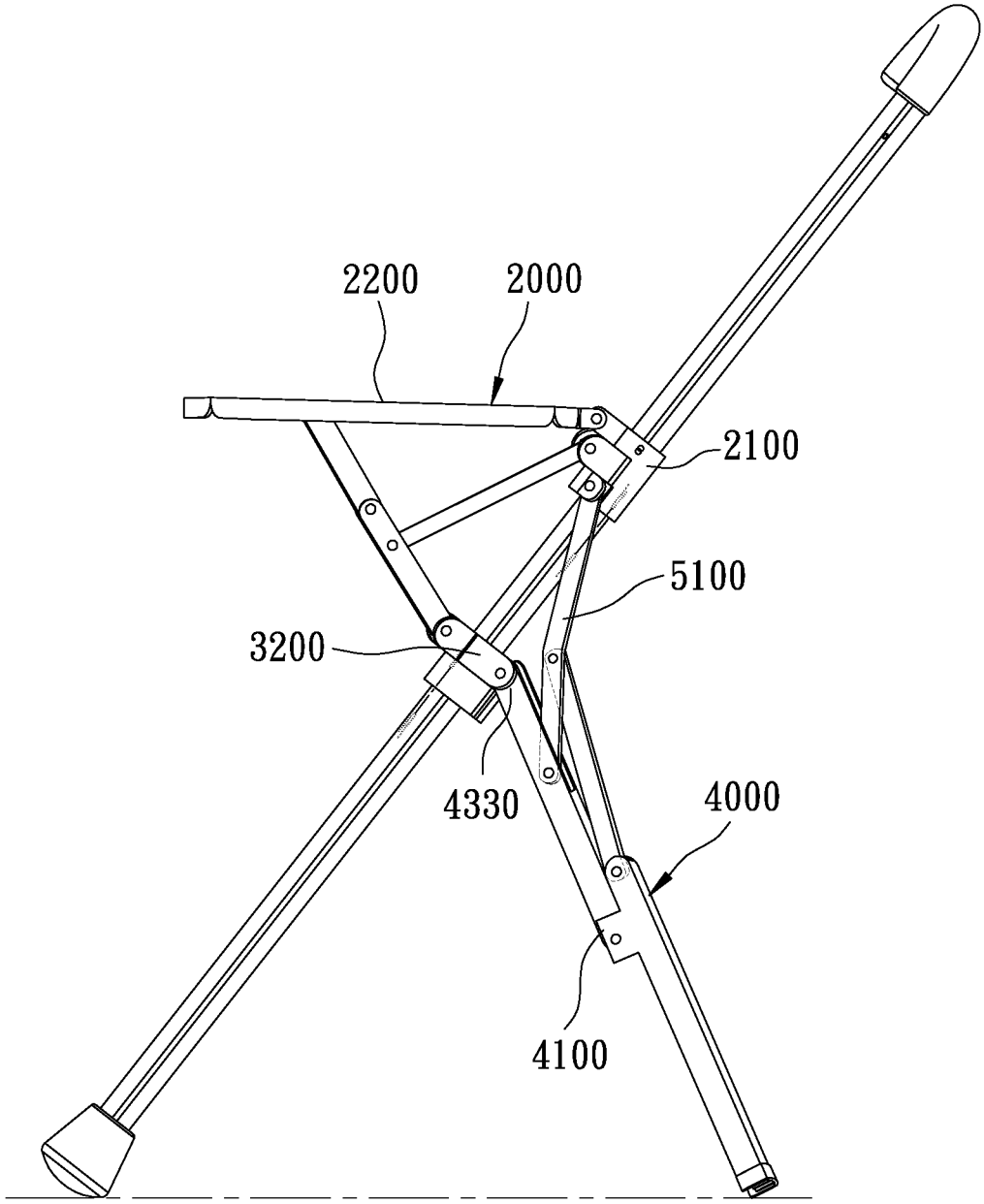
FIG. 16 is a side view of a variation of the fourth preferred embodiment.

Referring to FIG. 16, a variation of the fourth preferred embodiment illustrates that the pivoted end portion 4330 of each support leg 4100 of the support unit 4000 is connected pivotally to the middle slider member 3200. In this embodiment, an end of each of the linking member 5100 connected to the upper slider member 2100 may be connected to the seat member 2200 of the seat unit 2000.

Figure 17:
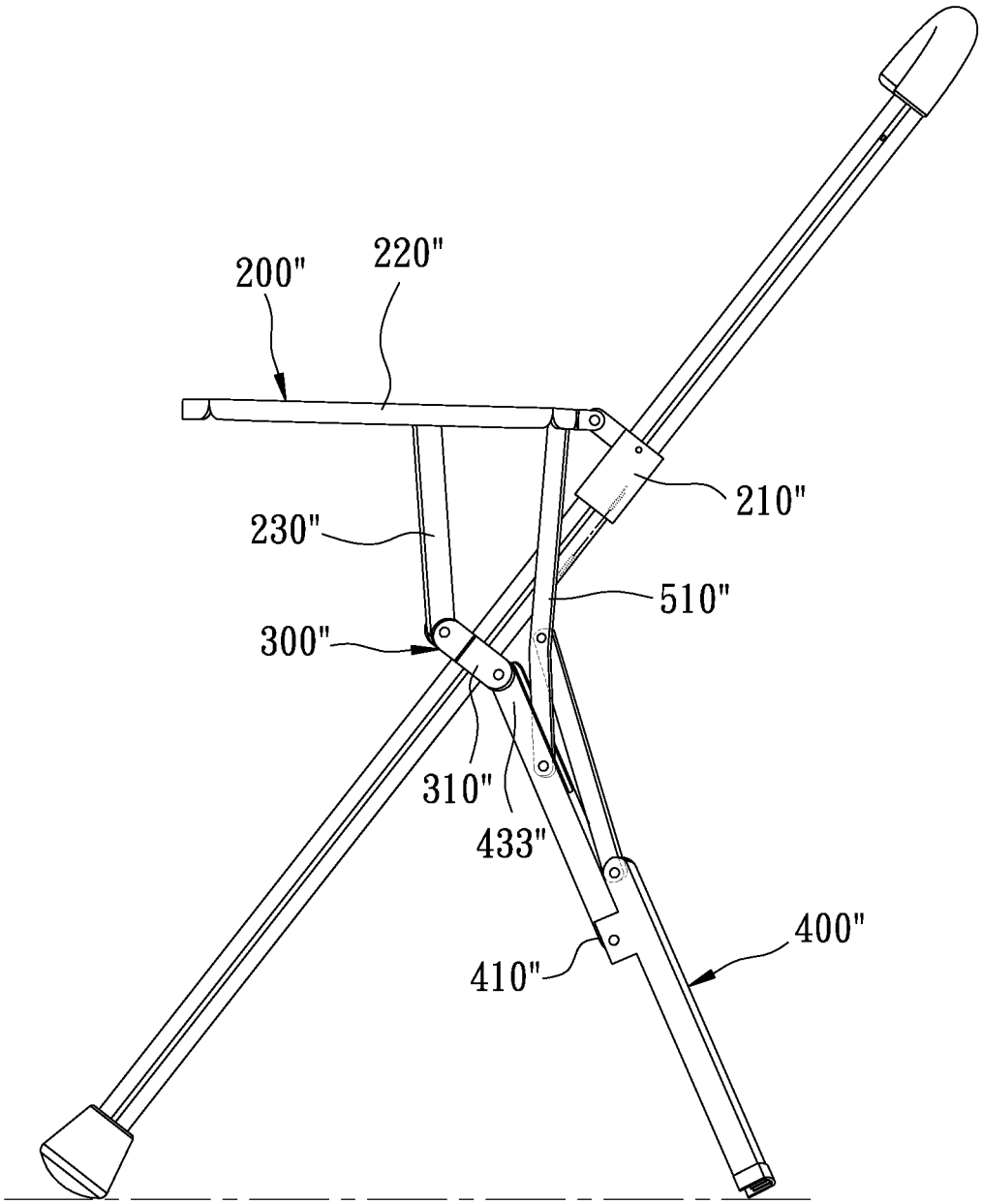
FIG. 17 is a side view of a fifth preferred embodiment according to the invention.

Referring to FIG. 17, a fifth preferred embodiment according to the invention includes a positioning unit 300" that merely includes the abutment member 310". Each linkage set 230" is connected pivotally between the abutment member 310" and the seat member 220" of the seat unit 200". The pivoted end portion 433" of each support leg 410" of the support unit 400" is connected pivotally to the abutment member 310". In this embodiment, an end of each of the linking member 510" connected to the seat member 220" of the seat unit 200' may be connected to the upper slider member 210".

Figure 18:
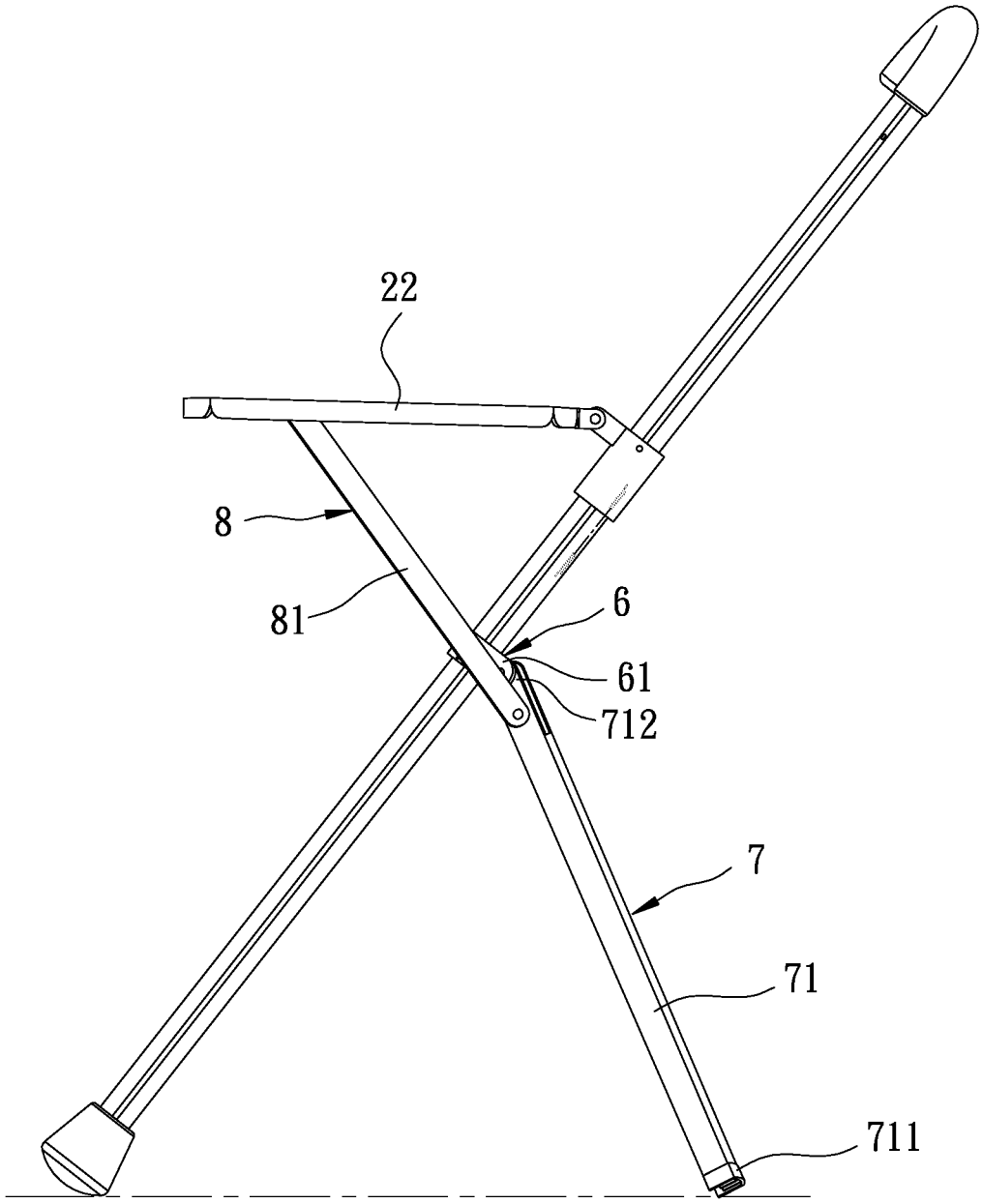
FIG. 18 is a side view of a sixth preferred embodiment according to the invention.

FIG. 18 shows a sixth preferred embodiment according to the invention. Each of the support legs 71 of the support unit 7 is configured as a single bar, and has one end serving as the pivoted end portion 712 that is connected pivotally to the abutment member 61 of the positioning unit 6, and an opposite end serving as the free end portion 711 for contacting the ground. Each linking member 81 of the linking unit 8 is configured as a single bar and is connected pivotally between the seat member 22 and a respective one of the support legs 71. In this embodiment, the linking unit 8 functions in supporting the seat member 22 and driving movement of the support unit 7.

Figure 19:
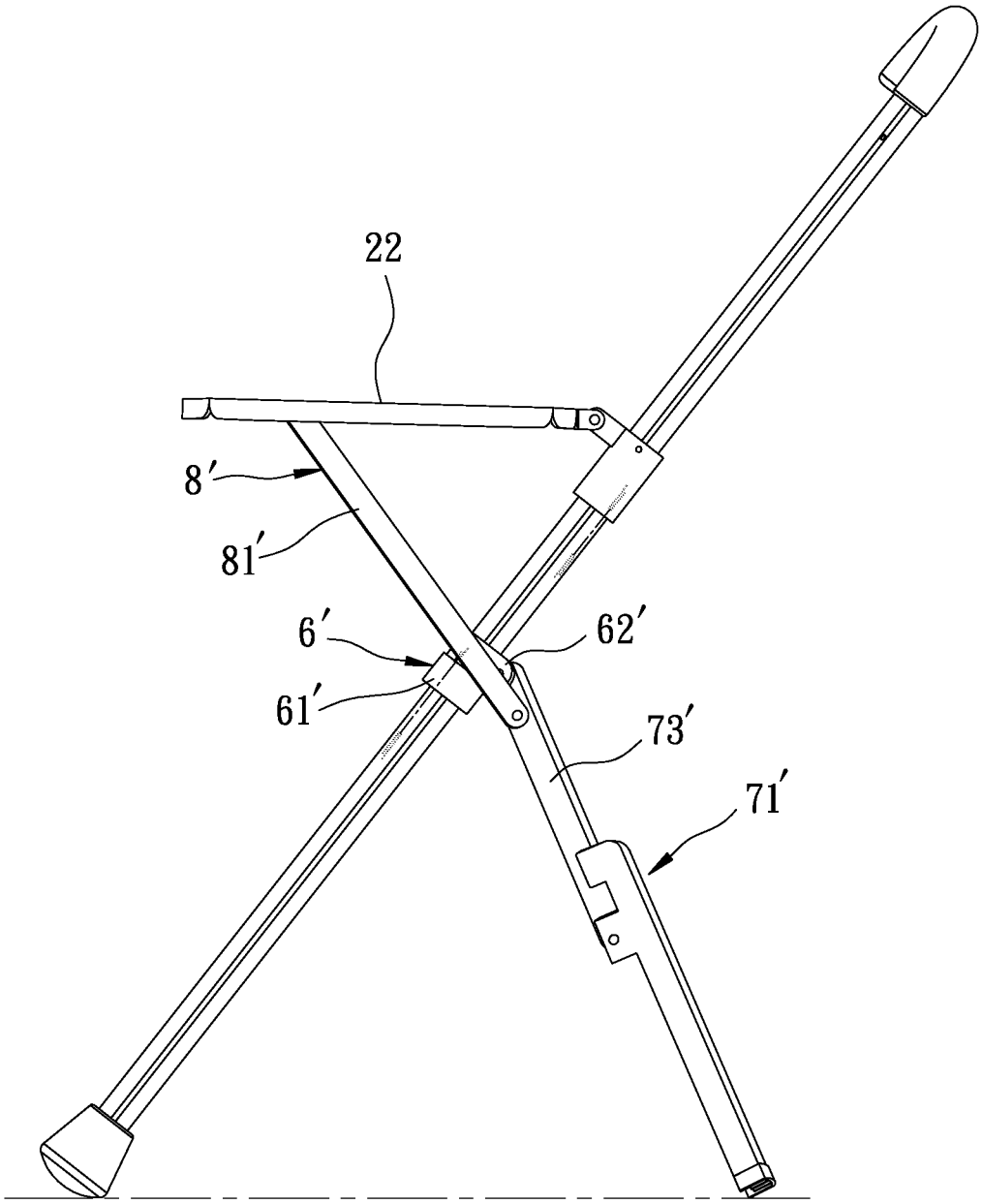
FIG. 19 is a side view of a seventh preferred embodiment according to the invention.

FIG. 19 shows a seventh preferred embodiment according to the invention. The positioning unit 6' includes the abutment member 61' and the middle slider member 62'. The upper leg component 73' of each support leg 71' is connected to the middle slider member 62'. Each linking member 81' of the linking unit 8' is configured as a single bar and is connected pivotally between the seat member 22 and the upper leg component 73'.

Figure 20:
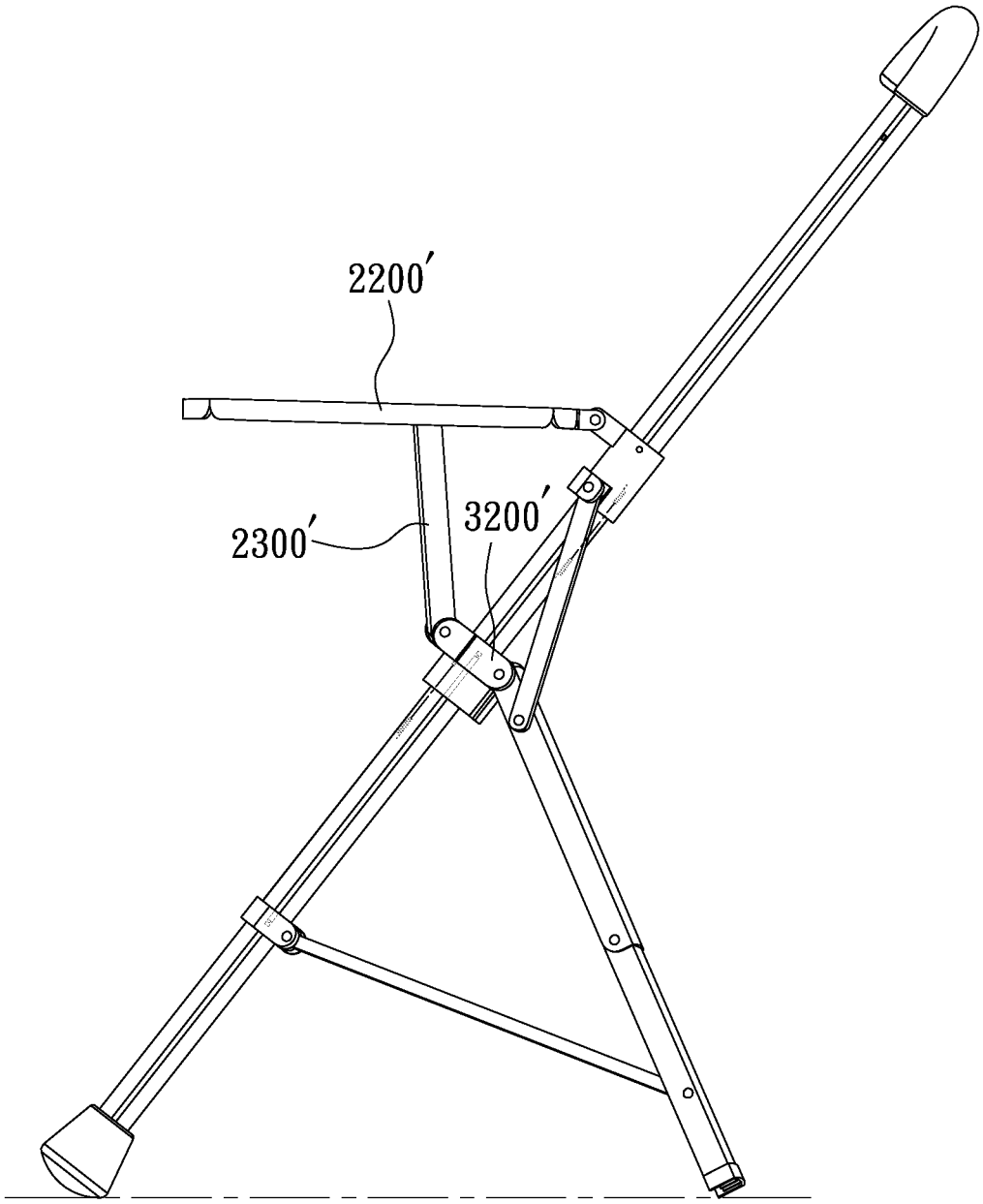
FIG. 20 is a side view of an eighth preferred embodiment according to the invention.

Referring to FIG. 20, an eighth preferred embodiment according to the invention differs from the first preferred embodiment in that each linkage set 2300' is configured as a single bar that has opposite ends connected pivotally and respectively to the seat member 2200' and the middle slider member 3200'.

Figure 21:
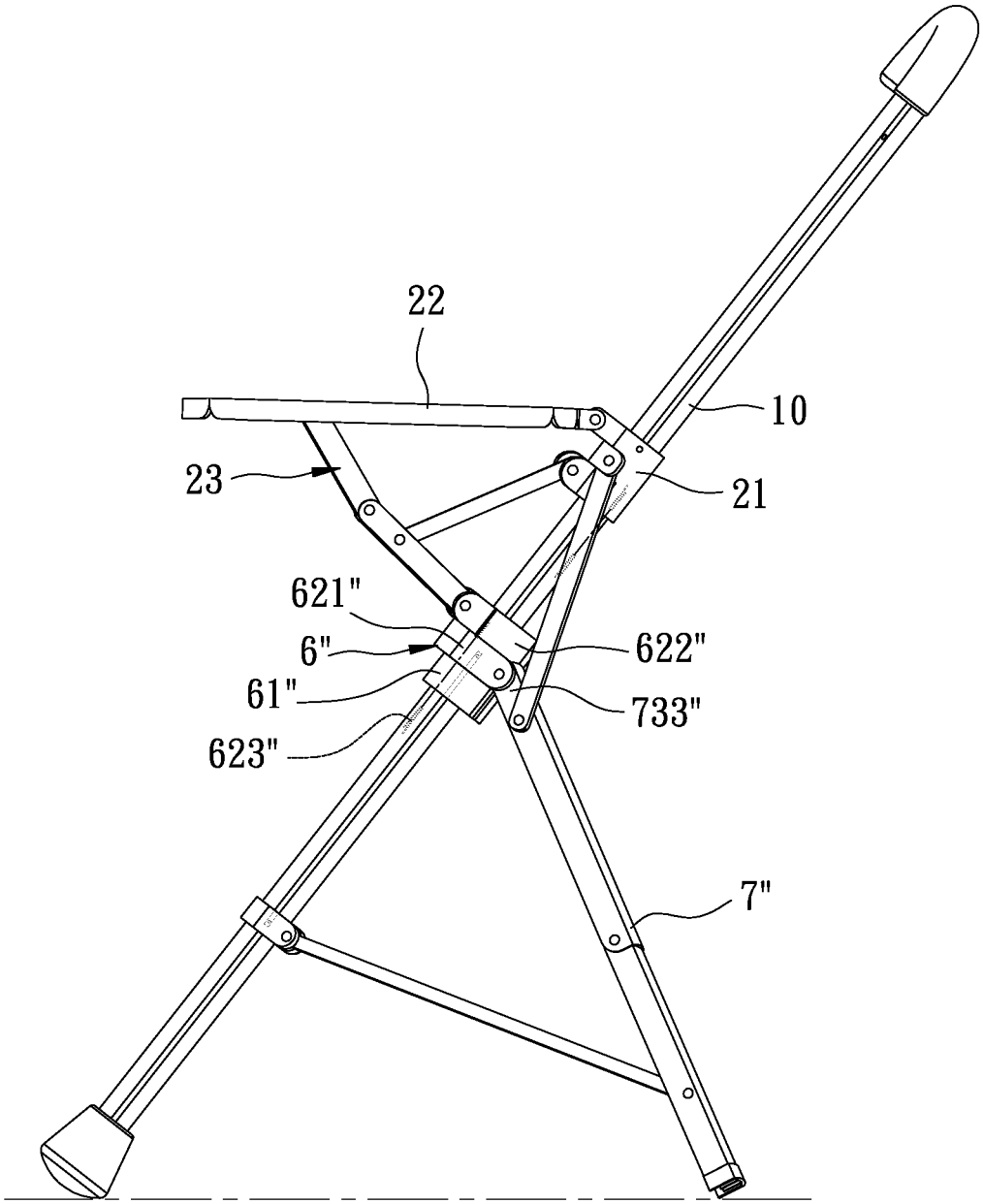
FIG. 21 is a side view of a ninth preferred embodiment according to the invention.
Figure 22:
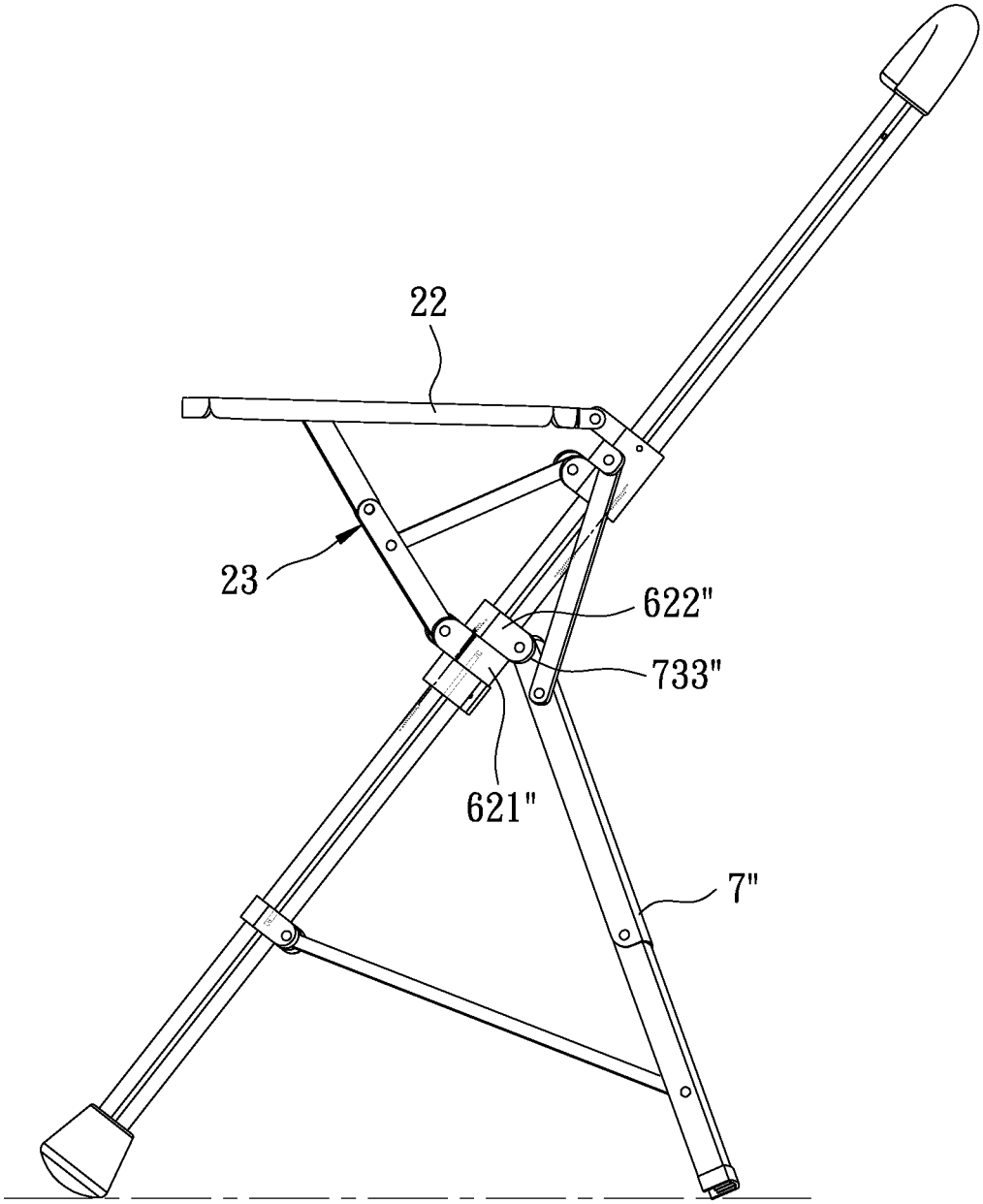
FIG. 22 is a side view of a variation of the ninth preferred embodiment.

Referring to FIGS. 21 and 22, a ninth preferred embodiment according to the invention and a variation thereof are similar to the first preferred embodiment. The difference is that the positioning unit 6" in this embodiment includes an abutment member 61", a pair of middle slider members 621", 622" that are connected slidably to the rod body 10 and that are disposed one above the other and between the abutment member 61" and the upper slider member 21, and a resilient member 623" that is connected between the upper one of the middle slider members 622" and the rod body 10 for biasing the upper one of the middle slider members 622" toward the abutment member 61". The linkage sets 23 and the pivoted end portions 733" of the support unit 7" are connected pivotally and respectively to the middle slider members 621", 622". When the upper slider member 21 is at the second position, a lower one of the middle slider members 621" abuts against the abutment member 61", and an upper one of the middle slider members 622" abuts against the lower one of the middle slider members 621".

Figure 23:
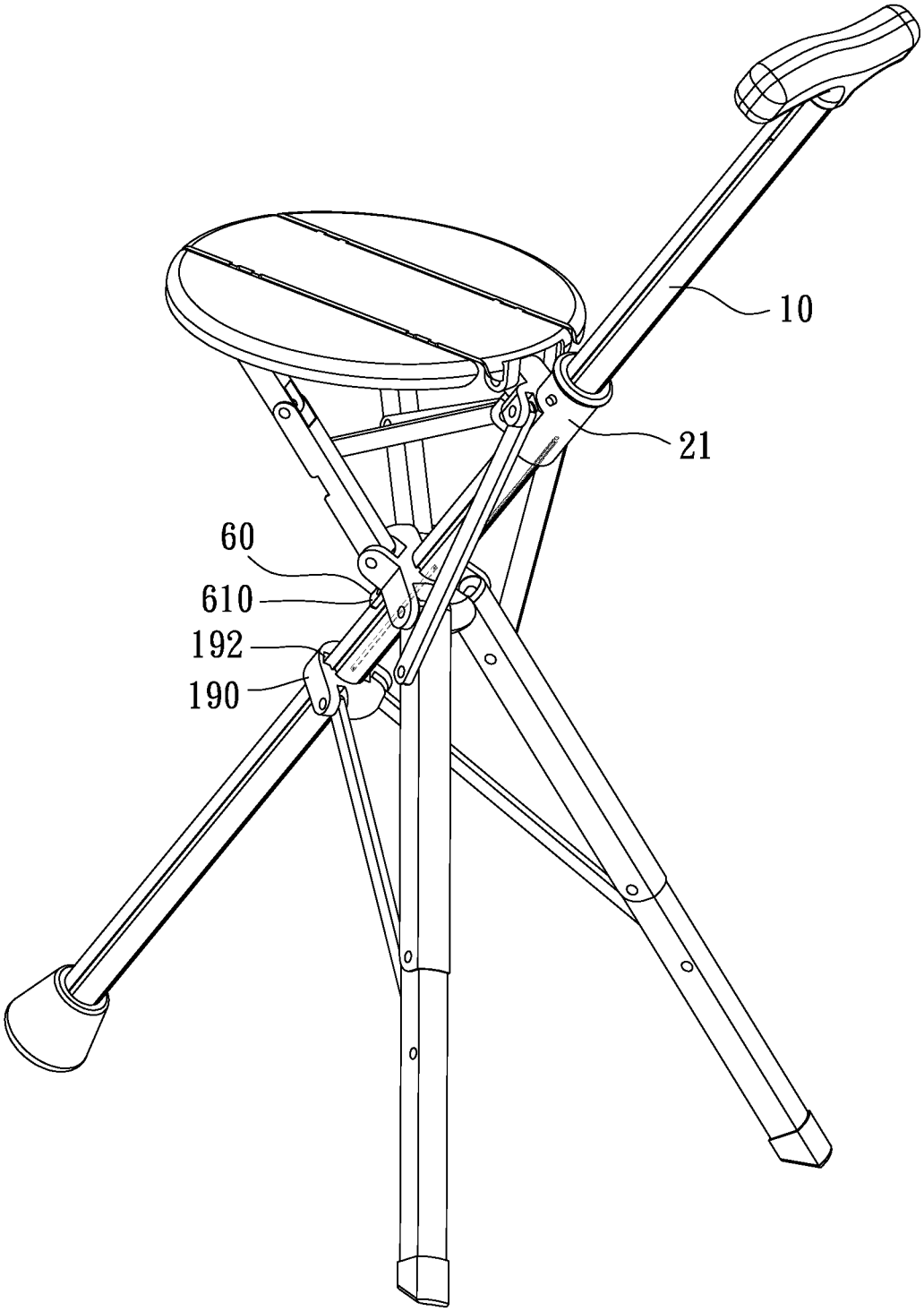
FIG. 23 is a perspective view of still another variation of the first preferred embodiment at an unfolded state.
Figure 24:
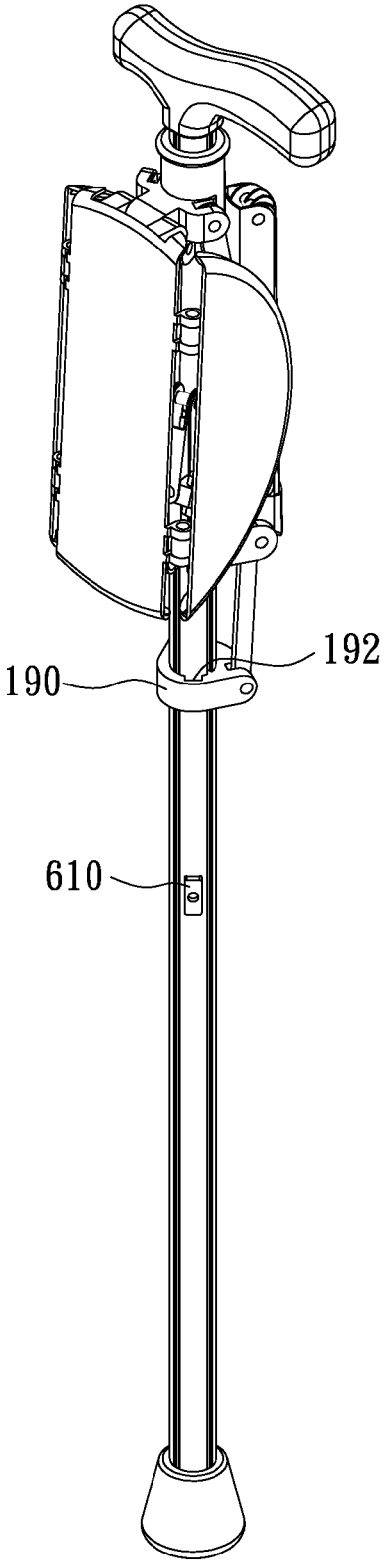
FIG. 24 is another perspective view of the preferred embodiment illustrated in FIG. 23 at a folded state.

FIG. 23 shows still another variation of the first preferred embodiment, and the difference therebetween is that the abutment member 610 of the positioning unit 60 is configured as a block protruding from an outer surface of the rod body 10. The lower slider member 190 has a passage groove 192 adjacent to the outer surface of the rod body 10. The passage groove 192 moves past the abutment member 610 to permit the lower slider member 190 to slide over the abutment member 610 when the upper slider member 21 moves from the second position to the uppermost position such that, as shown in FIG. 24, the abutment member 610 is under the lower slider member 190 when the upper slider member 21 is at the uppermost position.

Figure 25:
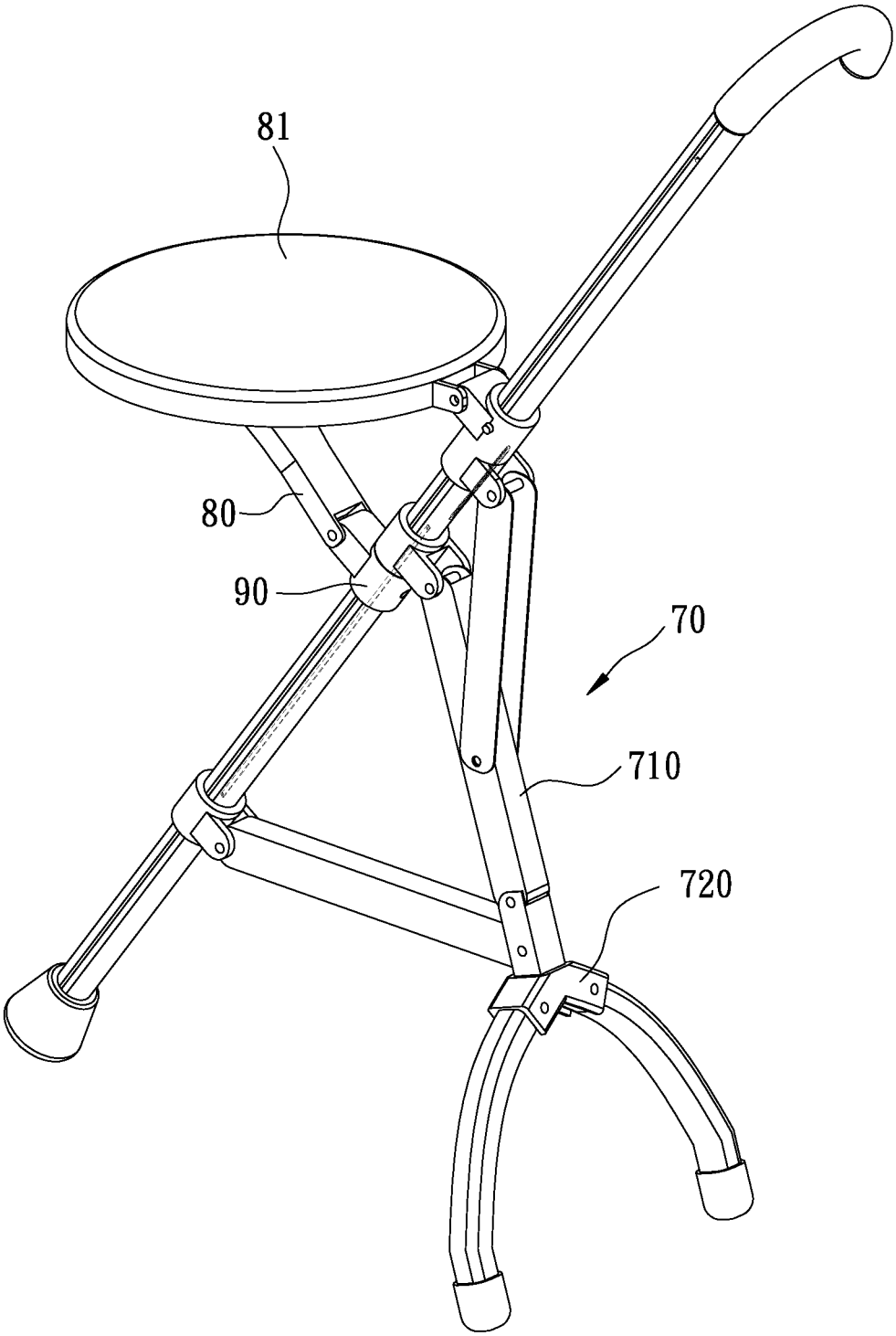
FIG. 25 is a perspective view of a tenth preferred embodiment according to the invention at an unfolded state.

Each of the embodiments in this invention so far has a pair of support legs. However, as shown in FIG. 25, a tenth preferred embodiment of this invention includes only one linkage set 80 that is configured as a single bar connected pivotally to the seat member 81 and the abutment member 90, and the support unit 70 that has only one upper leg component 710 and a furcated lower leg component 720 connected pivotally to the upper leg component 710.

Figure 26:
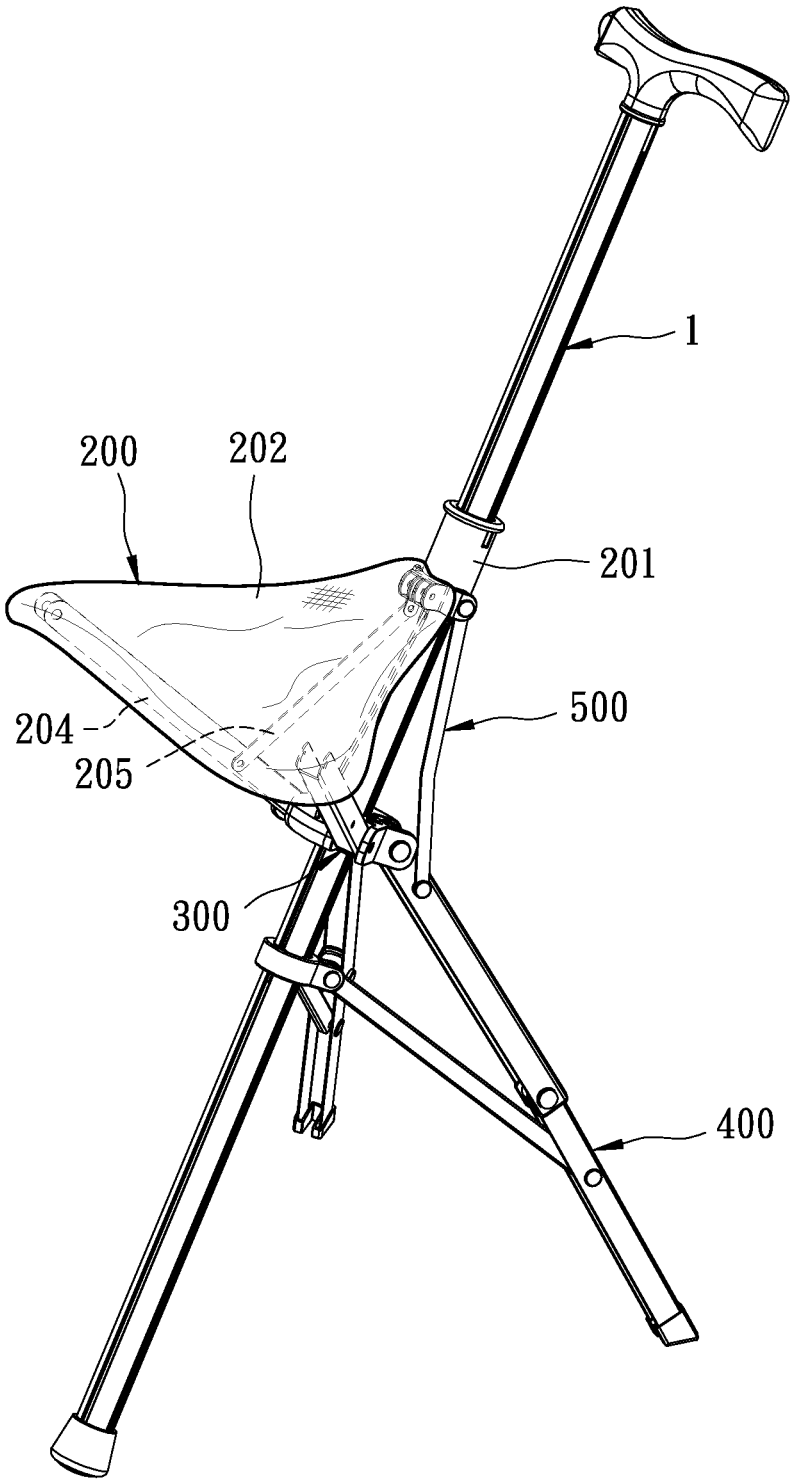
FIG. 26 is a perspective view of an eleventh preferred embodiment according to the invention at an unfolded state.
Figure 27:
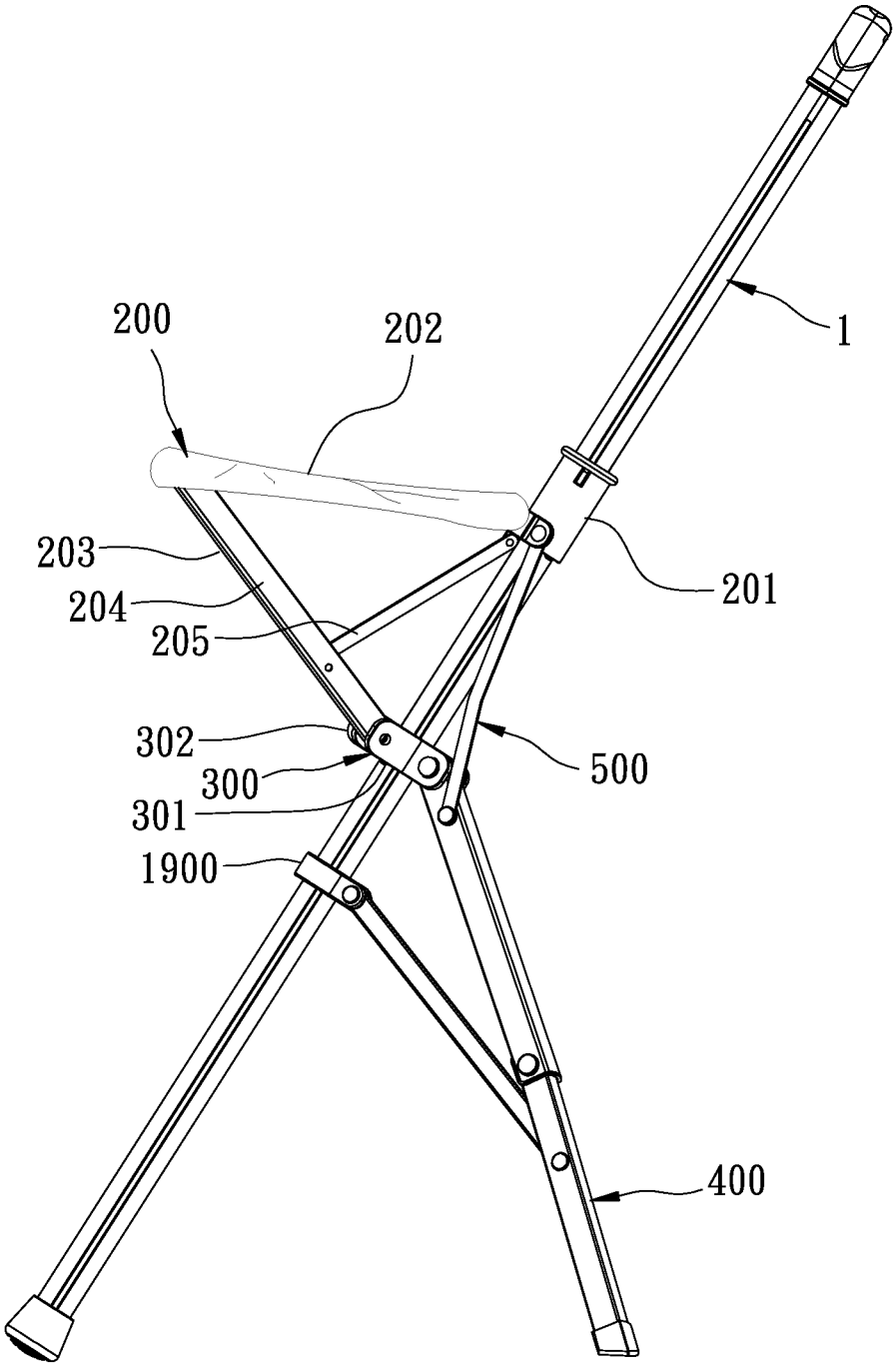
FIG. 27 is a side view of the eleventh preferred embodiment at the unfolded state.
Figure 28:
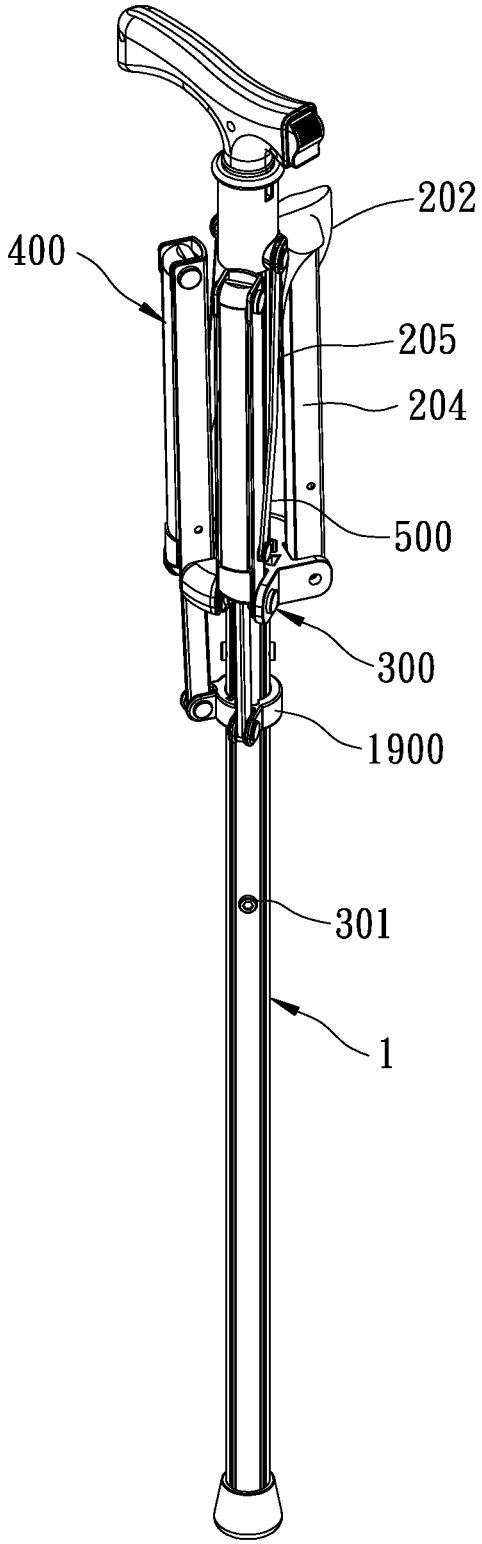
FIG. 28 is a perspective view of the eleventh preferred embodiment at a folded state.

Referring to FIGS. 26 to 28, an eleventh preferred embodiment of this invention is similar to the variation of the first preferred embodiment shown in FIG. 23. What is different is that the seat member 202 of the seat unit 200 is made of fabric (e.g., canvas) and is connected fixedly to the upper slider member 201, and that each of the linkage sets 203 includes a support bar 204 and a drive bar 205. The support bar 204 of each of the linkage sets 203 has opposite ends connected respectively to the seat member 202 and the middle slider member 302 of the positioning unit 300. The drive bar 205 of each of the linkage sets 203 has opposite ends connected pivotally and respectively to the corresponding support bar 204 at a pivot point between the opposite ends of the corresponding support bar 204 and the upper slider member 201. When the upper slider member 201 moves from the second position to the first position, the support unit 400 is driven to the folded state by the linking unit 500, and each of the support bars 204 is driven to pivot toward the main stick 1 by the corresponding drive bar 205 such that the seat member 202 deforms to be folded between the main stick 1 and the support bars 204. Moreover, similar to the embodiment illustrated in FIG. 23, the abutment member 301 is configured as a block and is under the lower slider member 1900 when the upper slider member 201 is at the uppermost position.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A walking stick chair, comprising:

a main stick having an elongated rod body that has opposite upper and lower ends, a handle portion that is connected to said upper end of said rod body, and a foot portion that is connected to said lower end of said rod body;

a seat unit including an upper slider member that is connected slidably to said rod body and that is movable along said rod body between a first position and a second position, said second position being distal from said handle portion, said first position being located between said handle portion and said second position, and a seat member that is connected to said upper slider member;

a support unit having a pivoted end portion that is connected pivotally to said rod body under said upper slider member of said seat unit, and a free end portion opposite to said pivoted end portion, said pivoted end portion of said support unit having a connecting point about which said support unit is pivotable relative to said rod body; and a linking unit disposed between and connected pivotally to said support unit and said seat unit, said linking unit being pivoted to said support unit at a pivot point between said connecting point of said pivoted end portion and said free end portion of said support unit, and being pivotable relative to said support unit about said pivot point;

wherein, when said upper slider member is at the second position, said seat member is at an unfolded state where said seat member and said rod body form an angle, and said support unit is at an unfolded state where said free end portion of said support unit is away from said rod body and cooperates with said foot portion for contacting ground and where the center of gravity of said support unit and said handle portion are respectively located at two opposite sides of said pivoted end portion of said support unit in the direction of said rod body; and wherein, when said upper slider member moves upwardly from the second position to the first position, said seat member moves toward said rod body to a folded state, and said linking unit is driven to move upwardly toward said handle portion to actuate said support unit to pivot upwardly toward said handle portion to a folded state where the center of gravity of said support unit and said handle portion are located at the same side of said pivoted end portion of said support unit in the direction of said rod body and where said free end portion is close to said rod body, such that the center of gravity of said support unit is moved toward said handle portion.

2. The walking stick chair as claimed in claim 1, further comprising a positioning unit including an abutment member that is connected immovably to said rod body under said upper slider member, said linking unit including a linking member that has a driven portion connected pivotally to said seat unit, and a driving portion connected pivotally to said pivot point of said support unit, said pivoted end portion being positioned relative to said rod body by said abutment member.

3. The walking stick chair as claimed in claim 2, wherein said positioning unit further includes a middle slider member that is connected slidably to said rod body and that is disposed between said abutment member and said upper slider member, said pivoted end portion of said support unit being connected pivotally to said middle slider member, said middle slider member abutting against said abutment member when said upper slider member is at the second position, said driven portion of said linking member being connected pivotally to one of said upper slider member and said seat member.

4. The walking stick chair as claimed in claim 3, wherein said positioning unit further includes a resilient member connected between said middle slider member and said rod body for biasing said middle slider member toward said abutment member.

5. The walking stick chair as claimed in claim 3, wherein:

said support unit includes at least one support leg that has an upper leg component and a lower leg component, said upper leg component having said pivoted end portion, said lower leg component having said free end portion and being connected pivotally to said upper leg component oppositely of said pivoted end portion, said driven portion of said linking member being connected pivotally to said seat unit, said driving portion of said linking member being connected pivotally to said upper leg component at a pivot point between said pivoted end portion and said lower leg component;

said positioning unit further includes a lower slider member connected slidably to said rod body and disposed between said middle slider member and said foot portion, and a connecting rod interconnecting co-movably said lower slider member and said middle slider member; and said support unit further includes an auxiliary linkage having opposite ends connected pivotally and respectively to said lower slider member (19, 190, 1900) and said lower leg component.

6. The walking stick chair as claimed in claim 5, wherein said abutment member of said positioning unit is configured as a block protruding from an outer surface of said rod body, said lower slider member having a passage groove adjacent to said outer surface of said rod body, said passage groove moving past said abutment member to permit said lower slider member to slide over said abutment member when said upper slider member moves toward said handle portion of said main stick.

7. The walking stick chair as claimed in claim 2, wherein said seat unit further includes a linkage set that is disposed between and connected to said seat member and said positioning unit, said linkage set pivoting toward said rod body when said upper slider member is moved to the first position, said linkage set pivoting away from said rod body when said upper slider member is moved to the second position, said driven portion of said linking member being connected pivotally to one of said upper slider member and said seat member.

8. The walking stick chair as claimed in claim 7, wherein said positioning unit further includes a middle slider member that is connected slidably to said rod body and that is disposed between said abutment member and said upper slider member, at least one of said linkage set and said pivoted end portion of said support unit being connected pivotally to said middle slider member, said middle slider member abutting against said abutment member when said upper slider member is at the second position.

9. The walking stick chair as claimed in claim 8, wherein said linkage set is connected pivotally to said middle slider member, said pivoted end portion of said support unit being connected pivotally to said middle slider member.

10. The walking stick chair as claimed in claim 2, wherein said seat unit further includes a resilient member connected between said upper slider member and said rod body for biasing said upper slider member toward said foot portion.

11. The walking stick chair as claimed in claim 2, wherein said support unit includes at least one support leg that has an upper leg component and a lower leg component, said upper leg component having said pivoted end portion, said lower leg component having said free end portion and being connected pivotally to said upper leg component oppositely of said pivoted end portion, said driven portion of said linking member being connected pivotally to one of said upper slider member and said seat member, said driving portion of said linking member being connected pivotally to said upper leg component at a pivot point between said pivoted end portion and said lower leg component.

12. The walking stick chair as claimed in claim 2, wherein said linking member has an upper end serving as said driven portion and pivoted to said seat unit, and a lower end serving as said driving portion, a length of said linking member being larger than a distance between said lower end of said linking member and said pivoted end portion of said support unit.

13. The walking stick chair as claimed in claim 2, wherein:

said driven portion of said linking member being connected pivotally to one of said upper slider member and said seat member;

said support unit includes at least one support leg that has said pivoted end portion and said free end portion provided respectively at opposite ends thereof;

said positioning unit further includes a lower slider member connected slidably to said rod body and disposed between said upper slider member and said foot portion; and said support unit further includes an auxiliary linkage having opposite ends connected pivotally and respectively to said lower slider member and said support leg.

14. The walking stick chair as claimed in claim 2, wherein said seat unit further includes a pair of linkage sets, each of which is disposed between and connected pivotally to said seat member and said positioning unit, said linkage sets pivoting toward said rod body when said upper slider member is moved to the first position, said linkage sets pivoting away from said rod body when said upper slider member is moved to the second position, said driven portion of said linking member being connected pivotally to one of said upper slider member and said seat member.

15. The walking stick chair as claimed in claim 2, wherein:

said seat member is made of fabric; and said seat unit further includes a linkage set including a support bar that has opposite ends connected respectively to said seat member and said positioning unit, and a drive bar that has opposite ends connected pivotally and respectively to said support bar at a pivot point between said opposite ends of said support bar and said upper slider member.

16. The walking stick chair as claimed in claim 1, wherein said rod body is formed with a groove extending in an outer surface of said rod body in a longitudinal direction of said rod body.

17. The walking stick chair as claimed in claim 16, wherein said upper slider member has a guide block engaging slidably said groove.

* * * * *